US011116263B2

(12) United States Patent
Czajka et al.

(10) Patent No.: US 11,116,263 B2
(45) Date of Patent: Sep. 14, 2021

(54) GOWN FOR SELF-DONNING WHILE MAINTAINING STERILITY AND METHODS THEREFOR

(71) Applicant: Medline Industries, Inc., Mundelein, IL (US)

(72) Inventors: Frank Czajka, Libertyville, IL (US); David Noskowicz, Spring Grove, IL (US); Amanda Jaron, Arlington Heights, IL (US)

(73) Assignee: Medline Industries, Inc., Northfield, IL (US)

( * ) Notice: Subject to any disclaimer, the term of this patent is extended or adjusted under 35 U.S.C. 154(b) by 85 days.

(21) Appl. No.: 14/086,798

(22) Filed: Nov. 21, 2013

(65) Prior Publication Data

US 2015/0135398 A1 May 21, 2015

(51) Int. Cl.
*A41D 13/12* (2006.01)

(52) U.S. Cl.
CPC ..... *A41D 13/12* (2013.01); *A41D 2400/44* (2013.01)

(58) Field of Classification Search
CPC ..... A41D 13/12; A41D 13/1236; A41D 2400/44; A41D 2400/52
USPC ..... 2/69, 114
See application file for complete search history.

(56) References Cited

U.S. PATENT DOCUMENTS 313,046 A 3/1885 Batdorf
371,353 A 10/1887 Perry
842,224 A 1/1907 Mills
850,960 A 4/1907 O'Connoor
884,063 A 4/1908 Baldwin
1,506,332 A 8/1924 Bloom
1,980,435 A 11/1934 Reagan
D108,151 S 1/1938 Cairns
2,172,162 A 8/1939 Gillette
2,292,347 A * 8/1942 Bailey ..... A41D 15/00 2/1
D136,385 S 9/1943 Pons
D136,386 S 9/1943 Pons
2,374,643 A 5/1945 Boettcher
(Continued)

FOREIGN PATENT DOCUMENTS

CA 2343482 10/2001
CA 2799116 8/2013
(Continued)

OTHER PUBLICATIONS

Vanatta, Amy "Non-Final Office Action", U.S. Appl. No. 12/720,360, filed Mar. 9, 2010; dated Oct. 11, 2011.
(Continued)

*Primary Examiner* — Clinton T Ostrup
*Assistant Examiner* — Jocelyn Bravo
(74) *Attorney, Agent, or Firm* — Philip H. Burrus, IV

(57) ABSTRACT

A gown (100) can include a body covering portion (101). The gown can optionally include sleeves (107,108) extending distally from the body covering portion. The gown can include a shoulder covering portion (106) defining a head insertion aperture (105). To make the gown self-donnable without compromising sterility of sterile portions, the body covering portion can include an accordion fold (302) or a rolled fold (303) beginning at an end (111) of the gown opposite the head insertion aperture and terminating at the sleeves.

18 Claims, 17 Drawing Sheets

(56) References Cited

U.S. PATENT DOCUMENTS

D146,506 S 3/1947 Kenny
2,430,941 A 11/1947 Long
2,431,466 A 11/1947 Barri
2,449,584 A 9/1948 Briton
2,556,931 A 6/1951 Miller
2,653,324 A 8/1953 McMahon
2,668,294 A 2/1954 Gilpin
2,673,347 A 3/1954 Weiss
2,825,902 A * 3/1958 Breier ..... A41D 3/00 2/93
2,971,198 A * 2/1961 Tomich ..... A41D 3/08 2/84
D193,132 S 7/1962 Rhoads et al.
3,129,432 A 4/1964 Belkin
3,130,462 A 4/1964 Mitchell
3,144,661 A * 8/1964 Buser ..... A61G 10/04 2/114
3,229,305 A 1/1966 Nevitt
3,276,036 A 10/1966 Carter et al.
D208,527 S 9/1967 Grengg
3,359,569 A * 12/1967 Scrivens ..... A41D 13/1209 2/114
3,397,406 A 8/1968 Leach
3,399,406 A 9/1968 Bradley
3,429,433 A * 2/1969 Holt ..... A41D 13/1209 206/216
3,451,062 A * 6/1969 Bradley ..... A41D 13/1236 2/114
3,540,441 A * 11/1970 Collins ..... A61B 19/08 128/855
3,625,206 A * 12/1971 Charnley ..... A41D 13/1218 128/846
3,696,443 A * 10/1972 Taylor ..... A41D 13/1209 2/114
3,707,964 A * 1/1973 Patience ..... A61B 19/08 128/856
3,721,997 A 3/1973 Mundt
3,721,999 A * 3/1973 Goya ..... A41D 13/1209 2/114
3,750,664 A 8/1973 Collins
3,803,640 A * 4/1974 Ericson ..... A41D 13/1209 2/114
3,824,625 A 7/1974 Green
D233,634 S 11/1974 Snider
3,858,243 A * 1/1975 Pierron ..... A41D 1/02 2/52
3,868,728 A 3/1975 Krzewinski
3,881,474 A 5/1975 Krzewinski
3,881,476 A * 5/1975 Bolker ..... A61B 19/08 128/855
D236,293 S 8/1975 Banks
3,921,221 A 11/1975 Zoephel
3,935,596 A * 2/1976 Allen, Jr. ..... A41D 13/1209 2/114
3,952,373 A 4/1976 Noorily
3,956,048 A 5/1976 Nordgren
3,968,792 A 7/1976 Small
3,989,040 A 11/1976 Lofgren et al.
4,000,521 A * 1/1977 Zoephel ..... A41D 13/1209 2/114
4,017,909 A * 4/1977 Brandriff ..... A41D 13/1209 2/158
4,040,124 A 8/1977 Zoephel
4,041,942 A 8/1977 Dougan et al.
4,119,093 A 10/1978 Goodman
4,119,095 A 10/1978 Lewis
4,134,398 A 1/1979 Scrivens
4,153,054 A 5/1979 Boone
4,171,542 A 10/1979 Cox et al.
D254,276 S 2/1980 Behrmann
4,214,320 A * 7/1980 Belkin ..... A41D 13/1209 2/114
RE30,520 E * 2/1981 Pierron ..... A41D 1/02 156/250
4,266,663 A 5/1981 Geraci
4,290,148 A * 9/1981 Roberts ..... A41D 13/1209 2/51
4,308,864 A 1/1982 Small et al.
4,315,334 A * 2/1982 Pearsall ..... A41D 3/02 2/85
4,323,062 A 4/1982 Canty
4,334,529 A 6/1982 Wirth
D267,830 S 2/1983 Arnseth et al.
4,384,573 A 5/1983 Elliott
4,408,357 A 10/1983 Toth
4,467,477 A * 8/1984 DeGennaro ..... A41D 3/00 2/108
4,476,587 A 10/1984 Itoi
4,476,860 A 10/1984 Collins et al.
4,479,492 A 10/1984 Singer
4,489,720 A 12/1984 Morris et al.
4,504,977 A 3/1985 King et al.
4,523,335 A * 6/1985 Scrivens ..... A41D 13/1209 2/114
4,535,481 A 8/1985 Ruth-Larson et al.
4,553,538 A 11/1985 Rafelson
4,561,126 A * 12/1985 Truman ..... A41D 13/1209 2/115
4,569,341 A 2/1986 Morris
4,570,268 A 2/1986 Freeman
4,596,245 A 6/1986 Morris
4,616,642 A 10/1986 Martin et al.
4,622,699 A 11/1986 Spriggs
4,627,427 A 12/1986 Acro
4,631,756 A * 12/1986 Scrivens ..... A41D 13/1209 2/114
4,653,120 A * 3/1987 Leaf ..... A41D 13/1236 2/114
4,664,103 A 5/1987 Martin et al.
4,674,132 A * 6/1987 Stein ..... A41D 13/1209 2/114
4,686,715 A 8/1987 Price
4,705,171 A * 11/1987 Eldridge ..... A61F 15/001 128/846
4,711,236 A 12/1987 Glassman
4,718,124 A 1/1988 Sawicki et al.
4,736,467 A 4/1988 Schwarze et al.
4,745,915 A 5/1988 Enright et al.
4,783,854 A * 11/1988 Bjorklund ..... A41D 13/1209 2/114
4,829,602 A 5/1989 Harreld et al.
4,864,657 A * 9/1989 Lake ..... A41D 13/1236 2/114
4,869,271 A 9/1989 Idris
D305,376 S 1/1990 Russell
D305,575 S 1/1990 Gordon et al.
4,905,710 A 3/1990 Jones
4,920,578 A 5/1990 Janzen et al.
4,942,987 A * 7/1990 Stackhouse ..... A41D 13/1209 2/114
4,951,317 A 8/1990 Gray et al.
4,951,318 A 8/1990 Harreld et al.
4,964,173 A 10/1990 Gordon
4,969,215 A 11/1990 Burkett
5,010,592 A * 4/1991 Skiles, Jr. ..... A41D 3/00 2/108
5,027,438 A 7/1991 Schwarze et al.
5,029,344 A * 7/1991 Shannon ..... A41D 15/005 2/115
5,033,115 A * 7/1991 Bowling ..... A41D 13/11 2/48
D319,113 S 8/1991 Adams
5,042,507 A 8/1991 Dowdy
5,061,246 A 10/1991 Anapliotis
5,063,919 A 11/1991 Silverberg
5,074,316 A 12/1991 Dowdy
5,088,116 A 2/1992 Gould
5,097,534 A * 3/1992 Viemeister ..... A41D 13/1209 2/114
5,109,873 A 5/1992 Marshall

(56) References Cited

U.S. PATENT DOCUMENTS 5,135,188 A 8/1992 Anderson et al.
5,136,758 A 8/1992 Wilcox et al.
5,140,996 A 8/1992 Sommers et al.
5,184,351 A 2/1993 Benstock
5,253,642 A * 10/1993 Stackhouse ..... A41D 13/11 128/201.25
5,271,100 A 12/1993 Holt
D348,974 S 7/1994 Whitwill
D351,712 S 10/1994 Jackson
5,362,306 A 11/1994 McCarver et al.
5,372,589 A 12/1994 Davis
5,377,387 A 1/1995 Freed
D356,204 S 3/1995 Derrickson
5,410,758 A * 5/1995 Dupont ..... A41D 13/1209 2/247
5,414,867 A * 5/1995 Bowling ..... A41D 13/1209 2/114
5,417,225 A 5/1995 Rubenstein et al.
5,444,871 A 8/1995 Lopez
5,444,872 A 8/1995 Johnson
5,444,873 A 8/1995 Levin
D362,331 S 9/1995 Berger, II
5,454,119 A 10/1995 Thomm
5,533,209 A * 7/1996 Davis ..... A41D 10/00 2/158
D374,113 S 10/1996 Console
5,561,861 A 10/1996 Lopez et al.
5,575,006 A 11/1996 Wolfe
5,605,534 A 2/1997 Hutchison
5,611,356 A 3/1997 Rothrum
5,674,189 A 10/1997 McDowell et al.
5,694,643 A 12/1997 Fujiwara
5,707,703 A 1/1998 Rothrum et al.
5,765,566 A 6/1998 Rothrum
5,768,707 A 6/1998 Lederer
5,784,718 A * 7/1998 Finnegan ..... A41D 1/04 2/247
5,806,094 A 9/1998 Kasun et al.
5,813,051 A 9/1998 Counter
5,813,052 A 9/1998 Taylor
5,816,253 A 10/1998 Sosabee
5,862,525 A * 1/1999 Tankersley ..... A41D 13/1209 2/105
5,867,825 A * 2/1999 Scheerer ..... A41D 13/1218 128/855
5,916,202 A 6/1999 Haswell
5,973,450 A 10/1999 Nishizawa et al.
5,975,082 A 11/1999 Dowdy
5,985,395 A 11/1999 Comstock et al.
D419,748 S 2/2000 Sartori
6,049,907 A 4/2000 Palomo
6,062,444 A * 5/2000 Tankersley ..... A41D 13/1209 223/37
6,105,579 A 8/2000 Levitt et al.
6,115,840 A 9/2000 Hastins
D431,344 S 10/2000 Briceno
6,138,278 A 10/2000 Taylor
6,196,033 B1 3/2001 Dowdle
6,216,270 B1 4/2001 Moquin et al.
6,235,659 B1 5/2001 McAmish et al.
6,244,268 B1 6/2001 Annett
6,272,685 B1 8/2001 Kumar
6,285,611 B1 9/2001 Kang
6,345,622 B1 2/2002 Chandler et al.
6,405,730 B2 2/2002 Levitt et al.
6,378,136 B2 8/2002 Matsushita
D463,093 S 9/2002 Murray
6,449,772 B1 9/2002 Donner et al.
D469,945 S 2/2003 Mayer
6,536,636 B1 3/2003 McDonniel
6,564,386 B2 * 5/2003 Fujikawa ..... A41D 13/1209 2/114
6,601,239 B2 8/2003 Drake
6,665,880 B2 12/2003 Poppe
6,694,981 B2 2/2004 Gingles et al.
6,742,522 B1 6/2004 Baker et al.
6,820,622 B1 11/2004 Teves et al.
6,843,252 B2 1/2005 Harrison et al.
6,990,686 B2 1/2006 Palmer
7,114,500 B2 10/2006 Bonutti
D533,982 S 12/2006 Graneto, III
7,181,773 B1 * 2/2007 Piraka ..... A41D 13/1281 2/114
7,237,271 B1 7/2007 McLandrich
7,290,547 B2 11/2007 Joseph et al.
7,305,991 B2 12/2007 Santilli et al.
D563,627 S 3/2008 Warren
D565,279 S 4/2008 Ferrell
7,370,369 B2 5/2008 Cheung
7,412,728 B2 * 8/2008 Alesina ..... A41D 27/28 2/69
D575,936 S 9/2008 Fenderson et al.
D579,178 S 10/2008 Snyder et al.
7,454,798 B2 11/2008 Feodoroff
D584,483 S 1/2009 Glynn
7,549,179 B1 * 6/2009 Saied ..... A41D 13/0012 2/114
D598,638 S 8/2009 Graneto, III
7,594,279 B2 9/2009 Roy
D608,980 S 2/2010 Brady
7,654,266 B2 2/2010 Corbitt, Jr.
D612,126 S 3/2010 Milgrom
7,673,754 B2 3/2010 Wilson, Jr. et al.
D618,884 S 7/2010 Zhu
D622,479 S 8/2010 Herzog
D622,934 S 9/2010 Graneto, III
7,819,911 B2 10/2010 Anderson et al.
7,841,020 B2 * 11/2010 Mayfield ..... A41D 13/02 2/227
7,926,120 B2 4/2011 Birmingham
7,971,274 B2 * 7/2011 Graneto, III ..... A41D 13/1209 2/114
8,006,836 B2 * 8/2011 Trombetta ..... B65D 77/062 2/243.1
D646,463 S 10/2011 Petrovskis et al.
D647,688 S 11/2011 Hilgart
8,056,146 B2 11/2011 Porowski
8,069,495 B2 * 12/2011 Kemper ..... A41D 13/1209 2/51
D653,019 S 1/2012 Bond
D655,479 S 3/2012 Umbach et al.
D657,530 S 4/2012 Farris et al.
8,162,137 B2 * 4/2012 Vellutato, Jr. ..... B65D 85/18 2/51
8,286,263 B2 10/2012 Sampson-Howlett
8,332,965 B1 12/2012 Ryer
8,343,182 B2 1/2013 Kirkham
8,375,466 B2 2/2013 Tasezen et al.
D680,709 S 4/2013 Blood
8,464,374 B1 * 6/2013 Thayer ..... A47G 9/06 2/69
D687,209 S 8/2013 Levine
D690,078 S 9/2013 Anderson
D698,529 S 2/2014 Vanneste
8,677,513 B2 3/2014 Mathis et al.
D719,721 S 12/2014 Bonfiglio
D721,870 S 2/2015 Levine
D736,493 S 8/2015 Pasko
D737,546 S 9/2015 Sewall
D741,044 S 10/2015 Pasko
9,330,799 B1 5/2016 Phillips
D774,729 S 12/2016 Pasko
D779,155 S 2/2017 Pasko et al.
D779,156 S 2/2017 Pasko
D785,284 S 5/2017 Pasko
D787,780 S 5/2017 Pasko
D791,434 S 7/2017 Pasko
D792,056 S 7/2017 Reese et al.
D836,297 S 12/2018 Pasko
2001/0032346 A1 10/2001 Matsushita et al.
2002/0095709 A1 * 7/2002 Fujikawa ..... A41D 13/1209 2/51

(56) References Cited

U.S. PATENT DOCUMENTS

2003/0121522 A1 7/2003 Gingles et al.
2003/0131401 A1 7/2003 Dilworth
2004/0019951 A1* 2/2004 Cioffi ..... A41D 1/00 2/85
2004/0103904 A1 6/2004 Auerbach et al.
2004/0123366 A1 7/2004 Schorr et al.
2004/0172734 A1* 9/2004 Hartbrodt ..... A41D 13/0012 2/97
2005/0044608 A1* 3/2005 Ambrose ..... A41D 13/1209 2/114
2005/0132465 A1 6/2005 Kathumbi-Jackson et al.
2005/0145254 A1 7/2005 Aboul-Hosn et al.
2005/0223468 A1 10/2005 Hatton
2006/0000002 A1 1/2006 Bergkvist
2006/0064797 A1 3/2006 Rowe
2006/0081261 A1 4/2006 Corbin, Jr.
2006/0107434 A1 5/2006 Rowe
2006/0117452 A1 6/2006 Ambrose
2006/0117456 A1* 6/2006 Griesbach, III ... A41D 13/1209 2/114
2006/0177655 A1 8/2006 Mizohata et al.
2006/0191541 A1 8/2006 Aboul-Hosn et al.
2006/0236440 A1* 10/2006 Zahler ..... A41D 1/02 2/69
2006/0277655 A1 12/2006 Kerr
2006/0277668 A1* 12/2006 Plut ..... A41D 13/02 2/457
2006/0286334 A1 12/2006 Harpole
2007/0061940 A1* 3/2007 Cazares ..... A41D 7/008 2/86
2007/0102005 A1 5/2007 Bonutti
2007/0130668 A1 6/2007 Berman et al.
2008/0006279 A1 1/2008 Bodenham et al.
2008/0023013 A1 1/2008 Tuke et al.
2008/0047567 A1 2/2008 Bonutti
2008/0115253 A1 5/2008 Gorman
2008/0155728 A1 7/2008 Hafer et al.
2008/0178365 A1* 7/2008 Furgerson ..... A41D 1/04 2/85
2009/0165186 A1 7/2009 Mijares et al.
2009/0183529 A1* 7/2009 Modiano ..... A41D 1/04 66/171
2009/0320177 A1 12/2009 Lin et al.
2010/0031966 A1* 2/2010 Allen ..... A61B 19/08 128/851
2010/0064408 A1 3/2010 Kemper
2010/0138975 A1 6/2010 Jordan et al.
2010/0212063 A1 8/2010 Baucom et al.
2010/0299805 A1* 12/2010 Graneto, III ..... A41D 13/1209 2/114
2010/0300459 A1 12/2010 Lair
2010/0313323 A1* 12/2010 Tennelle ..... A41D 15/002 2/69
2011/0023210 A1* 2/2011 Porowski ..... A41D 13/1209 2/114
2011/0024485 A1* 2/2011 Porowski ..... A41D 13/1209 229/87.16
2011/0154554 A1* 6/2011 Furlong ..... A41D 13/1209 2/114
2011/0167534 A1* 7/2011 Wong ..... B29C 65/08 2/114
2011/0231981 A1 9/2011 Appel et al.
2011/0315150 A1 12/2011 Bream, Jr.
2012/0047623 A1 3/2012 van Oudenallen et al.
2012/0054940 A1 3/2012 Halseth
2012/0060257 A1* 3/2012 Herzog ..... A41D 13/1236 2/114
2012/0124722 A1* 5/2012 Yadav ..... A62B 17/006 2/457
2012/0305541 A1 12/2012 Giles
2012/0312308 A1* 12/2012 Allen ..... A61B 19/08 128/853
2013/0091615 A1 4/2013 Pasko et al.
2013/0091616 A1* 4/2013 Muche ..... A41D 13/1209 2/114
2013/0191960 A1 8/2013 Pasko
2013/0198930 A1 8/2013 Levine
2013/0239290 A1* 9/2013 Rossi ..... A41D 7/008 2/84
2013/0276204 A1* 10/2013 Pasko ..... A41D 13/12 2/114
2013/0318682 A1 12/2013 Graneto, III
2014/0007316 A1* 1/2014 Tommarello ..... A41D 13/1236 2/114
2014/0082816 A1* 3/2014 Christopher ..... A41D 27/08 2/69
2014/0173814 A1* 6/2014 Yadav ..... A62B 17/006 2/457
2014/0182043 A1 7/2014 Moore
2014/0189931 A1 7/2014 Fredrickson
2014/0215681 A1* 8/2014 Goodman ..... A41D 1/00 2/69
2015/0089712 A1* 4/2015 Gamble ..... A41D 15/00 2/88
2015/0096099 A1* 4/2015 Vanneste ..... A41D 13/02 2/79
2015/0113698 A1* 4/2015 Gregersen-Brown ... A41D 1/00 2/69
2015/0135397 A1 5/2015 Levine
2015/0135398 A1 5/2015 Czajka et al.
2015/0208741 A1* 7/2015 Pasko ..... A41D 13/12 2/114
2015/0213215 A1 7/2015 Kobayashi et al.
2018/0343940 A1 12/2018 Genender

FOREIGN PATENT DOCUMENTS

| | | |
|---|---|---|
| CN | 302083878 | 9/2012 |
| DE | 8904426 | 5/1989 |
| DE | 202006005966 | 10/2006 |
| DE | 102009024999 | 12/2010 |
| DE | 102011016497 | 10/2012 |
| EM | 001320857 | 3/2012 |
| EP | 143204 | 6/1985 |
| EP | 0335041 | 10/1989 |
| EP | 335041 | 10/1989 |
| EP | 1362520 | 11/2003 |
| EP | 1407324-0001 | 5/2014 |
| EP | 1407324-0002 | 5/2014 |
| EP | 1407324-0003 | 5/2014 |
| EP | 1407324-0004 | 5/2014 |
| FR | 2709643 | 3/1995 |
| KR | 101116311 | 3/2012 |
| WO | 99/04721 | 2/1999 |
| WO | 2007/083032 | 7/2007 |
| WO | 2008/1461 | 12/2008 |
| WO | 2014159401 | 10/2014 |

OTHER PUBLICATIONS

Harris, Raymond E., "Non-Final Office Action", U.S. Appl. No. 12/537,961, filed Aug. 7, 2009; dated Nov. 9, 2011.
Vanatta, Amy B., "Notice of Allowance", U.S. Appl. No. 12/720,360, filed Mar. 9, 2012; dated Feb. 9, 2012.
Harris, Raymond E., "Final Office Action", U.S. Appl. No. 12/537,961, filed Aug. 7, 2009; dated Apr. 11, 2012.
Harris, Raymond E., "NonFinal OA", U.S. Appl. No. 12/537,961, filed Aug. 17, 2009; dated Jul. 17, 2012.
Lee, Cheol Soo "International Search Report", PCT/US2012/032122; Filed Apr. 4, 2012; dated Nov. 1, 2012.
Harris, Raymond E., "Final OA", U.S. Appl. No. 12/537,961, filed Aug. 7, 2009; dated Nov. 21, 2012.
Byun, Sung C., "PCT Search Report", PCT No. PCT/US2012/052079; Filed Aug. 23, 2012; dated Dec. 26, 2012.
Chang, Bong Ho "PCT Search Report and Written Opinion", PCT/US2012/054659; Filed Sep. 11, 2012; dated Feb. 26, 2013.
Haden, Sally C., "NonFinal OA", U.S. Appl. No. 13/276,232, filed Oct. 18, 2011; dated Apr. 8, 2013.

(56) References Cited

OTHER PUBLICATIONS

Hicks, Victoria "NonFinal OA", U.S. Appl. No. 13/116,473, filed May 26, 2011; dated May 16, 2013.
Haden, Sally C., "Final OA", U.S. Appl. No. 13/276,232, filed Oct. 18, 2011; dated Jul. 17, 2013.
Haden, Sally C., "NonFinal OA", U.S. Appl. No. 13/925,617, filed Jun. 24, 2013; dated Aug. 14, 2013.
Hicks, Victoria "Final OA", U.S. Appl. No. 13/116,473, filed May 26, 2011; dated Nov. 22, 2013,
Haden, Sally C., "Final OA", U.S. Appl. No. 13/925,617, filed Jun. 24,2007; dated Dec. 3, 2013.
Hicks, Victoria "NonFinal OA", U.S. Appl. No. 13/229,743, filed Sep. 11, 2011; dated Feb. 10, 2014.
Haden, Sally , "Appeal Decision", U.S. Appl. No. 13/804,565, filed Mar. 14, 2013; dated Jan. 8, 2019.
Haden, Sally , "Appeal Decision", U.S. Appl. No. 13/925,532, filed Jun. 24, 2013; dated Jan. 8, 2019.
Haden, Sally , "Notice of Allowance", U.S. Appl. No. 13/925,532, filed Jun. 24, 2013; dated Jan. 11, 2019.
McVey, Lauren , "NonFinal OA", U.S. Appl. No. 29/545,806, filed Nov. 16, 2015; dated Feb. 12, 2019.
McVey, Lauren , "Notice of Allowance", U.S. Appl. No. 29/545,802, filed Nov. 16, 2015; dated Feb. 19, 2019.
3M Product Clinical Data Summary for No. 1521, 3M Plastic Medical Tape, Jan. 1996 (2 pages).
3M Technical Information Sheet, Product No. 1521, Feb. 2007 (2 pages).
Blue Medical Gown; Manufactured by Medline Industries, Inc.; Unknown availability date but believed to be prior to 1999.
Country Living down under. <URL: http://countrylivingdownunder.yuku.com/topic/6395/How-to-attach-elastic-to-gather-andto-shit#.WQCbi_krJaQ.> Jun. 2, 2014. Gathering with elastic.
Definition of Progressive. Merriam-Webster. Merriam-Webster, n.d. Web. May 17, 2016.
Description and Photographs of 75-1040 Fenestrated Snap Drape (as of Oct. 6, 2008) (1 page).
Description and Photographs of a Perforated Drape With Tear Line (as of Oct. 6, 2008) (1 page).
Description and Photographs of D-09875-001 Snap Drape (as of Oct. 6, 2008 2008) (1 page).
Description and Photographs of Perforated Drapes (as of Oct. 6, 2008) (2 pages).
Disposable Medical Gown; Elastic Cuffs; Salamint, posted at salaaming.com, posting date n/a, copyright 2015 salamin.com, online, site visit Mar. 11, 2016; Available from https://www.salamint.com/productdetail.aspx?id=358.
Disposable Medical Gown; Thumb Loop Plastic Disposable Medical Surgical Gown, posting date n/a, copyright 1999-2016 alibaba.com; site visited Mar. 11, 2016, available from http://www.alibaba.com/product-detail/CPE-Gown-Thumb-loop-White-color_60043196775.html.
European Search Report for European Application No. 09167307.9 dated Oct. 11, 2010 (5 pages).
Fashion Flats, <URLL http:fashion-flats.com/images/1_details_set_in_sleeves.jpr> Visited May 21, 2015; Types of set-in sleeves.
Go Japan Go. <URL: http://www.gojapangp.com/fashion/hadajuban_kimono.html>. Visited Feb. 4, 2016. Hadajuban.
Jendela Sastra. <URL: http://www.jendelasatra.com/karya/puisi/hadajuban-dalam-kimono>. Poem with picture published Jan. 10, 2014. Hadajuban (first layer of kimono).
Lyst. <URL: https://ww.lyst.com/clothing/chritophe-lemaire-yak-hair-wool-thumbhole-sweater-moss-stone/.> Visited Apr. 26, 2017
U.S. Appl. No. 29/545,806; Chritophe Lemaire Thumbhole Sweater.
Medical Single Coated Film Tapes Selection Guide—Polyolefin & Vinyl, Nov. 1996 (3 pages).
Rakuten. <URL: http://global.rakuten.com/en/store/753ya/item/100131328/[2/4/2016%201:51:48%20PM]>. Visited Feb. 4, 2016. Hada-Juban.
Sakura-San. <URL: http://www.sakura-san.de/Juban.htm> Saved Jul. 12, 2013. Juban Furisode and Hada-Juban layers for kimono.
The visual dictionary. <URL: http://www.infovisual.info/06/049_en.html> Jun. 1, 2013. types of cuffs.
Vintage Patterns Wikia. <URL: https//vintagepatterns.wikia.com/wiki/Butterikc_5374.> visited Dec. 9, 2015. Butterick 5374—Vintage Sewing Blouse Pattern.
"Appeal Decision", U.S. Appl. No. 13/276,232, filed Oct. 18, 2011; dated May 31, 2016.
"BurdaStyle Women's Size Chart", http://www.burdastyle.com/downloads/SizeChart_Regular_inches.pdf; Publication Date Unknown.
"Medline Catalog", 2-Ply Sterile Cotton Stockinette by Alba-Waldensian Medline Catalog; http://www.medline.com/catalog/catalog.jsp; Unknown Publication date but believed to be prior to present application filing date.
"Medline Catalog", Cotton Stockinette by Alba-Waldensian; Medline Catalog; http://www.medline.com/catalog/catalog.jsp; Unknown Publication date but believed to be prior to present application filing date,.
"Medline Catalog", Full BodyDrapes by Halyard Health; Medline Catalog; http://www.medline.com/catalog/catalog.jsp; Unknown Publication date but believed to be prior to present application filing date.
"Medline Catalog", K-C100 Mayo Stand Covers by Halyard Health: Medline Catalog; http://www.medline.com/catalog/catalog.jsp; Unknown Publication date but believed to be prior to present application filing date.
"Medline Catalog", Midline Cath Picc Kits by Medikmark; Medline Catalog; http://www.medline.com/catalog/catalog.jsp; Unknown Publication date but believed to be prior to present application filing date.
"Medline Catalog", PICC Full Body Coverage Pack by Halyard Health; Medline Catalog; http://www.medline.com/catalog/catalog.jsp; Unknown Publication date but believed to be prior to present application filing date.
"Medline Catalog", Single Ply Standard Stockinettes by DeRoyal: Medline Catalog; http://www.medline.com/catalog/catalog.jsp; Unknown Publication date but believed to be prior to present application filing date.
"Medline Catalog", Single-Ply Sterile Stockinettes by Kerma Medical: Medline Catalog; http://www.medline.com/catalog/catalog.jsp; Unknown Publication date but believed to be prior to present application filing date.
"Medline Catalog", Sterile Bias Cute Cuttron Stockinette by Alba-Waldensian; Medline Catalog; http://www.medline.com/catalog/catalog.jsp; Unknown Publication date but believed to be prior to present application filing date.
"Medline Catalog", Stockinette by Derma Sciences; Medline Catalog; http://www.medline.com/catalog/catalog.jsp; Unknown Publication date but believed to be prior to present application filing date.
"Medline Catalog", Strl Stockinette Cttn 1-Ply by Alba-Waldensian; Medline Catalog; http://www.medline.com/catalog/catalog.jsp; Unknown Publication date but believed to be prior to present application filing date.
"Medline Catalog", TG Stockinettes by Lohmann and Rauscher; Medline Catalog; http://www.medline.com/catalog/catalog.jsp; Unknown Publication date but believed to be prior to present application filing date.
"Medline Catalog", Tube, Luki 864304; Medline Catalog; http://www.medline.com/catalog/catalog.jsp; Unknown Publication date but believed to be prior to present application filing date.
"Office Action", Canadian Office Action for Canadian Patent No. 2,674,951 dated May 4, 2011 (3 pages).
"Publication", Fashion Flats by Garment Element; By Art Design Projects Inc.; www.fashioncroquis.com; visited May 21, 2015; types of raglan sleeves.
Cline, Sally , "Restriction Req", U.S. Appl. No. 13/804,565, filed Mar. 14, 2013; dated Aug. 13, 2015.
Fitts, Carissa , "Final OA", U.S. Appl. No. 29/404,295, filed Oct. 18, 2011; dated Feb. 19, 2015.
Fitts, Carissa , "Final OA", U.S. Appl. No. 29/404,296, filed Oct. 18, 2011; dated Jul. 2, 2015.
Fitts, Carissa , "Final OA", U.S. Appl. No. 29/467,622, filed Sep. 20, 2013; dated Jul. 12, 2016.

(56) References Cited

OTHER PUBLICATIONS

Fitts, Carissa , "Final OA", U.S. Appl. No. 29/536,646, filed Aug. 18, 2015; dated Oct. 4, 2017.
Fitts, Carissa , "NonFinal OA", U.S. Appl. No. 29/404,295, filed Oct. 18, 2011; dated Jul. 1, 2014.
Fitts, Carissa , "NonFinal OA", U.S. Appl. No. 29/404,296, filed Oct. 18, 2011; dated Apr. 22, 2016.
Fitts, Carissa , "NonFinal OA", U.S. Appl. No. 29/404,296, filed Oct. 8, 2011; dated Oct. 9, 2014.
Fitts, Carissa , "NonFinal OA", U.S. Appl. No. 29/467,622, filed Sep. 20, 2013; dated Dec. 30, 2015.
Fitts, Carissa , "NonFinal OA", U.S. Appl. No. 29/467,622, filed Sep. 20, 2013; dated May 2, 2017.
Fitts, Carissa , "NonFinal OA", U.S. Appl. No. 29/467,623, filed Sep. 20, 2013; dated Jan. 13, 2016.
Fitts, Carissa , "NonFinal OA", U.S. Appl. No. 29/536,646, filed Aug. 18, 2015; dated Jun. 27, 2017.
Fitts, Carissa , "Notice of Allowance", U.S. Appl. No. 29/404,296, filed Oct. 18, 2011; dated Oct. 7, 2016.
Fitts, Carissa , "Notice of Allowance", U.S. Appl. No. 29/467/,622, filed Sep. 20, 2013; dated Sep. 26, 2017.
Fitts, Carissa C , "Notice of Allowance", U.S. Appl. No. 29/467/,623, filed Sep. 20, 2013; dated Jan. 13, 2017.
Haden, Sally , "Appeal Decision", U.S. Appl. No. 13/925,617, filed Jun. 24, 2013; dated June 6, 2017.
Haden, Sally , "Final OA", U.S. Appl. No. 13/925,598, filed Jun. 24, 2013; dated Sep. 6, 2016.
Haden, Sally , "NonFinal OA", U.S. Appl. No. 13/276,232, filed Oct. 18, 2011; dated Aug. 11, 2016.
Haden, Sally , "NonFinal OA", U.S. Appl. No. 13/925,532, filed Jun. 24, 2013; dated Jan. 8, 2016.
Haden, Sally , "NonFinal OA", U.S. Appl. No. 13/925,598, filed Jun. 24, 2013; dated Dec. 15, 2015.
Haden, Sally , "NonFinal Office Action", U.S. Appl. No. 13/925,617, filed Jun. 24, 2013; dated May 21, 2018.
Haden, Sally , "Notice of Allowance", U.S. Appl. No. 13/925,617, filed Jun. 24, 2013; dated Sep. 12, 2017.
Haden, Sally C. , "Final OA", U.S. Appl. No. 13/804,565, filed Mar. 14, 2013; dated May 19, 2016.
Haden, Sally C. , "Final OA", U.S. Appl. No. 13/804,565, filed Mar. 14, 2013; dated May 8, 2017.
Haden, Sally C. , "Final OA", U.S. Appl. No. 14/942,755, filed Nov. 16, 2015; dated Mar. 27, 2018.
Haden, Sally C. , "Final Office Action", U.S. Appl. No. 13/276,232, filed Oct. 18, 2011; dated Jan. 13, 2017.
Haden, Sally C. , "NonFinal OA", U.S. Appl. No. 13/804,565, filed Mar. 14, 2013; dated Oct. 29, 2015.
Haden, Sally C. , "NonFinal OA", U.S. Appl. No. 13/925,617, filed Jun. 24, 2013; dated Aug. 13, 2014.
Haden, Sally C. , "NonFinal OA", U.S. Appl. No. 14/679,628, filed Apr. 6, 2015; dated Sep. 5, 2017.
Haden, Sally Cline , "Final OA", U.S. Appl. No. 13/925,532, filed Jun. 24, 2013; dated Sep. 26, 2016.
Haden, Sally Cline , "NonFinal OA", U.S. Appl. No. 13/804,565, filed Mar. 14, 2013; dated Jan. 19, 2017.
Haden, Sally Cline , "NonFinal OA", U.S. Appl. No. 13/925,532, filed Jun. 24, 2013; dated Aug. 9, 2017.
Haden, Sally Cline , "NonFinal OA", U.S. Appl. No. 13/925,532, filed Jun. 24, 2013; dated May 23, 2016.
Haden, Sally Cline , "NonFinal OA", U.S. Appl. No. 13/925,598, filed Jun. 24, 2013; dated May 24, 2016.
Haden, Sally Cline , "NonFinal OA", U.S. Appl. No. 14/942,755, filed Nov. 16, 2015; dated Sep. 8, 2017.
Haines, Kimberly , "Notice of Allowance", U.S. Appl. No. 13/116,473, filed May 26, 2011; dated May 2, 2017.
Hicks, Victoria , "Final OA", U.S. Appl. No. 13/229,743, filed Sep. 11, 2011; dated Aug. 7, 2014.
Hicks, Victoria , "Final OA", U.S. Appl. No. 13/589,640, filed Aug. 20, 2012; dated Jan. 2, 2015.
Hicks, Victoria , "NonFinal OA", U.S. Appl. No. 13/589,640, filed Aug. 20, 2012; dated Jun. 13, 2014.
Hicks, Victoria , "Notice of Allowance", U.S. Appl. No. 13/116,473, filed May 26, 2011; dated Aug. 15, 2017.
Hicks, Victoria , "Notice of Allowance", U.S. Appl. No. 13/229,743, filed Sep. 11, 2011; dated Jan. 2, 2018.
Hicks, Victoria , "Notice of Allowance", U.S. Appl. No. 13/589,640, filed Aug. 20, 2012; dated Dec. 19, 2017.
Lee, Jong Kyung , "PCT Search Report and Written Opinion", PCT/US2014/023432; Filed Mar. 11, 2014; dated Jul. 10, 2014.
McVey, Lauren , "Ex Parte Quayle", U.S. Appl. No. 29/467,603, filed Sep. 20, 2013; dated Jul. 26, 2017.
McVey, Lauren , "Final OA", U.S. Appl. No. 29/459,047, filed Jun. 25, 2013; dated Sep. 24, 2015.
Mcvey, Lauren , "Final OA", U.S. Appl. No. 29/467,616, filed Sep. 20, 2013; dated Nov. 3, 2015.
McVey, Lauren , "Final OA", U.S. Appl. No. 29/467,619, filed Sep. 20, 2013; dated Oct. 20, 2015.
McVey, Lauren , "Final OA", U.S. Appl. No. 29/467,621, filed Sep. 20, 2013; dated Apr. 11, 2016.
McVey, Lauren , "Final OA", U.S. Appl. No. 29/467,603, filed Sep. 20, 2013; dated Feb. 10, 2016.
McVey, Lauren , "Final Office Action", U.S. Appl. No. 29/467,603, filed Sep. 20, 2013; dated Feb. 8, 2017.
McVey, Lauren , "NonFinal OA", U.S. Appl. No. 29/459,047, filed Jun. 25, 2013 dated Apr. 23, 2015.
McVey, Lauren , "NonFinal OA", U.S. Appl. No. 29/467,603, filed Sep. 30, 2015; dated Jun. 30, 2015.
McVey, Lauren , "NonFinal OA", U.S. Appl. No. 29/467,612, filed Sep. 20, 2013; dated Jun. 5, 2015.
McVey, Lauren , "NonFinal OA", U.S. Appl. No. 29/467,616, filed Sep. 20, 2013; dated Jun. 17, 2015.
McVey, Lauren , "NonFinal OA", U.S. Appl. No. 29/467,621, filed Sep. 20, 2013; dated Aug. 26, 2015.
McVey, Lauren , "NonFinal OA", U.S. Appl. No. 29/467,625, filed Sep. 20, 2013; dated Jul. 29, 2015.
McVey, Lauren , "NonFinal OA", U.S. Appl. No. 29/545,802, filed Nov. 16, 2015; dated Jun. 1, 2017.
McVey, Lauren , "NonFinal OA", U.S. Appl. No. 29/545,805, filed Nov. 16, 2015; dated Jun. 2, 2017.
McVey, Lauren , "NonFinal OA", U.S. Appl. No. 29/545,806, filed Nov. 16, 2015; dated Jun. 1, 2017.
McVey, Lauren , "Notice of Allowance", U.S. Appl. No. 29/459,047, filed Jun. 25, 2013; dated Aug. 10, 2016.
McVey, Lauren , "Notice of Allowance", U.S. Appl. No. 29/459,047, filed Jun. 25, 2013; dated Oct. 19, 2016.
McVey, Lauren , "Notice of Allowance", U.S. Appl. No. 29/459,060, filed Jun. 25, 2013; dated Apr. 23, 2015.
McVey, Lauren , "Notice of Allowance", U.S. Appl. No. 29/467,616, filed Sep. 20, 2013; dated Aug. 10, 2016.
McVey, Lauren , "Notice of Allowance", U.S. Appl. No. 29/467,620, filed Sep. 20, 2013; dated Jun. 23, 2015.
McVey, Lauren , "Notice of Allowance", U.S. Appl. No. 29/467,621, filed Sep. 20, 2013; dated Oct. 20, 2016.
McVey, Lauren , "Notice of Allowance", U.S. Appl. No. 29/467,623, filed Sep. 20, 2013; dated Aug. 30, 2016.
McVey, Lauren D. , "NonFinal OA", U.S. Appl. No. 29/467,619, filed Sep. 20, 2013; dated May 20, 2015.
Walshon, Rashida , "Final OA", U.S. Appl. No. 29/506,290, filed Oct. 14, 2014; dated Jul. 28, 2016.
Walshon, Rashida , "NonFinal OA", U.S. Appl. No. 29/506,290, filed Oct. 14, 2014; dated Jan. 20, 2016.
Walshon, Rashida , "NonFinal OA", U.S. Appl. No. 29/591,354, filed Jan. 19, 2017; dated Oct. 4, 2017.
Wright, Jennifer , "NonFinal OA", U.S. Appl. No. 29/506,294, filed Oct. 14, 2014; dated Mar. 28, 2016.
Wright, Jennifer , "NonFinal OA", U.S. Appl. No. 29/506,294, filed Oct. 14, 2014; dated Sep. 23, 2016.
Fitts, Carissa , "Notice of Allowance", U.S. Appl. No. 29/536,646, filed Aug. 18, 2015; dated Jul. 3, 2018.
McVey, Lauren , "Final OA", U.S. Appl. No. 29/545,805, filed Nov. 16, 2015; dated May 17, 2018.

(56) References Cited

OTHER PUBLICATIONS

McVey, Lauren , "Final OA", U.S. Appl. No. 29/545,806, filed Nov. 16, 2015; dated May 17, 2018.
McVey, Lauren , "Final Office Action", U.S. Appl. No. 29/545,802, filed Nov. 16, 2015; dated May 17, 2018.
Walshon, Rashida , "Non-FInal OA", U.S. Appl. No. 29/591,354, filed Jan. 19, 2017; dated Apr. 17, 2018.
Haden, Sally, "Appeal Decision", U.S. Appl. No. 13/276,232, filed Oct. 18, 2011; dated Sep. 17, 2018.
Haden, Sally, "Appeal Decision", U.S. Appl. No. 13/925,598, filed Jun. 24, 2013; dated Sep. 7, 2018.
Haden, Sally , "Notice of Allowance", U.S. Appl. No. 13/276,232, filed Oct. 18, 2011; dated Dec. 20, 2018.
Harris, Raymond E. , "Appeal Decision", U.S. Appl. No. 12/573,961, filed Aug. 7, 2009; dated Mar. 6, 2017.
Harris, Raymond E. , "Notice of Allowance", U.S. Appl. No. 12/537,961, filed Aug. 7, 2009; dated Oct. 6, 2017.
McVey, Lauren , "NonFinal OA", U.S. Appl. No. 29/545,805, filed Nov. 16, 2015; dated Dec. 10, 2018.
Walshon, Rashida, "Final Office Action" U.S. Appl. No. 29/591,354; dated Nov. 13, 2018.
Haden, Sally , "Final OA", U.S. Appl. No. 13/925,617, filed Jun. 24, 2013; dated Oct. 25, 2018.
Haden, Sally C. , "Final OA", U.S. Appl. No. 14/679,628, filed Apr. 6, 2015; dated Oct. 25, 2018.
The visual dictionary. <URL: http://www.infovisual.info/06/049_en.html>. types of cuffs (Examiner provided updated NPL (viewed Apr. 24, 2019) May 16, 2019 from original views Examiner provided in U.S. Appl. No. 29/467,612 on Jun. 5, 2015).
Haden, Sally , "Notice of Allowance", U.S. Appl. No. 14/679,628, filed Apr. 6, 2015; dated Mar. 29, 2019.
Haden, Sally C. , "Notice of Allowance", U.S. Appl. No. 13/804,565, filed Mar. 14, 2013; dated Mar. 28, 2019.
McVey, Lauren , "NonFinal OA", U.S. Appl. No. 20/545,806, filed Nov. 16, 2015; dated May 3, 2019.
McVey, Lauren , "NonFinal OA", U.S. Appl. No. 29/545,805, filed Nov. 16, 2015; dated May 16, 2019.
Walshon, Rashida , "Notice of Allowance", U.S. Appl. No. 29/591,354, filed Jan. 19, 2017; dated Jun. 19, 2019.
Haden, Sally , "Notice of Allowance", U.S. Appl. No. 13/276,232, filed Oct. 18, 2011; dated Sep. 3, 2019.
Haden, Sally , "Notice of Allowance", U.S. Appl. No. 13/925,532, filed Jun. 24, 2013; dated Sep. 3, 2019.
Haden, Sally Cline , "Appeal Decision", U.S. Appl. No. 13/925,617, filed Jun. 24, 2013; dated Oct. 17, 2019.
Haden, Sally Cline , "Notice of Allowance", U.S. Appl. No. 14/679,628, filed Apr. 6, 2015; dated Sep. 17, 2019.
Walshon, Rashida , "Notice of Allowance", U.S. Appl. No. 29/591,354, filed Jan. 19, 2017; dated Oct. 8, 2019.

* cited by examiner

FIG. 9
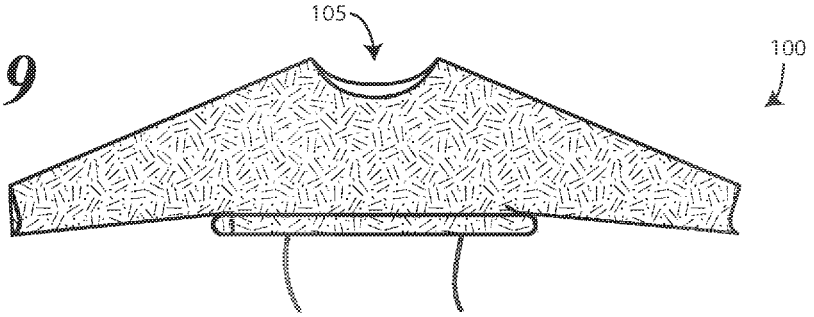
FIG. 10
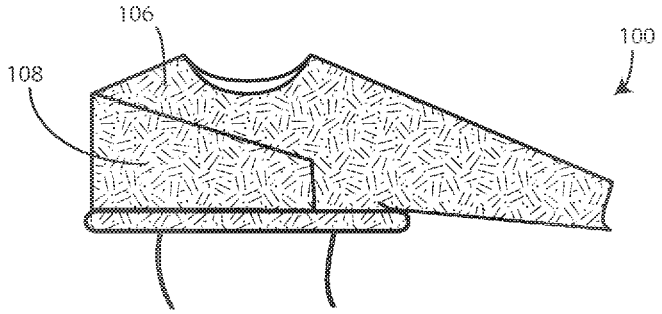
FIG. 11
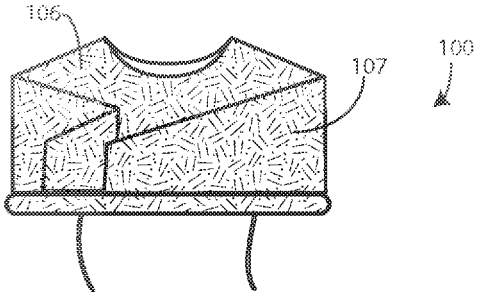
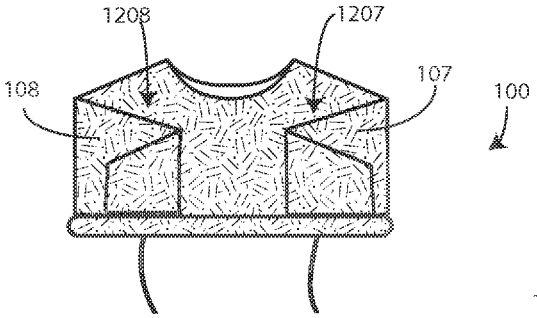
FIG. 12
FIG. 13
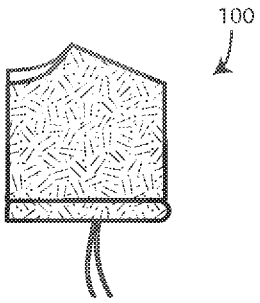

GOWN FOR SELF-DONNING WHILE MAINTAINING STERILITY AND METHODS THEREFOR

BACKGROUND

Technical Field

This disclosure relates generally to gowns, and more particularly to medical gowns.

Background Art

Medical gowns are commonly used in hospitals, clinics and other diagnostic facilities. Medical gowns are worn by both users and health care providers during medical procedures. Medical gowns serve a protective function by helping to prevent the transmission of germs and microbes. Additionally, gowns worn by the user provide a privacy function and help to preserve user dignity by covering the user's body prior to examination or prior to a medical procedure. For instance, prior to surgery, donning a medical gown serves as a "cover-up" in that it covers the user's unclad body until the procedure can be performed.

One issue with prior art medical gowns is that they are time-consuming to put on and take off. Additionally, where the gown is sterile, it is difficult to don a gown without compromising the gown's exterior sterility. It would be advantageous to have an improved medical gown.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

FIG. 9 illustrates one explanatory gown and method step in accordance with one or more embodiments of the disclosure.

FIG. 10 illustrates one explanatory gown and method step in accordance with one or more embodiments of the disclosure.

FIG. 11 illustrates one explanatory gown and method step in accordance with one or more embodiments of the disclosure.

FIG. 12 illustrates one explanatory gown and method step in accordance with one or more embodiments of the disclosure.

FIG. 13 illustrates one explanatory gown and method step in accordance with one or more embodiments of the disclosure.

Figure 1:
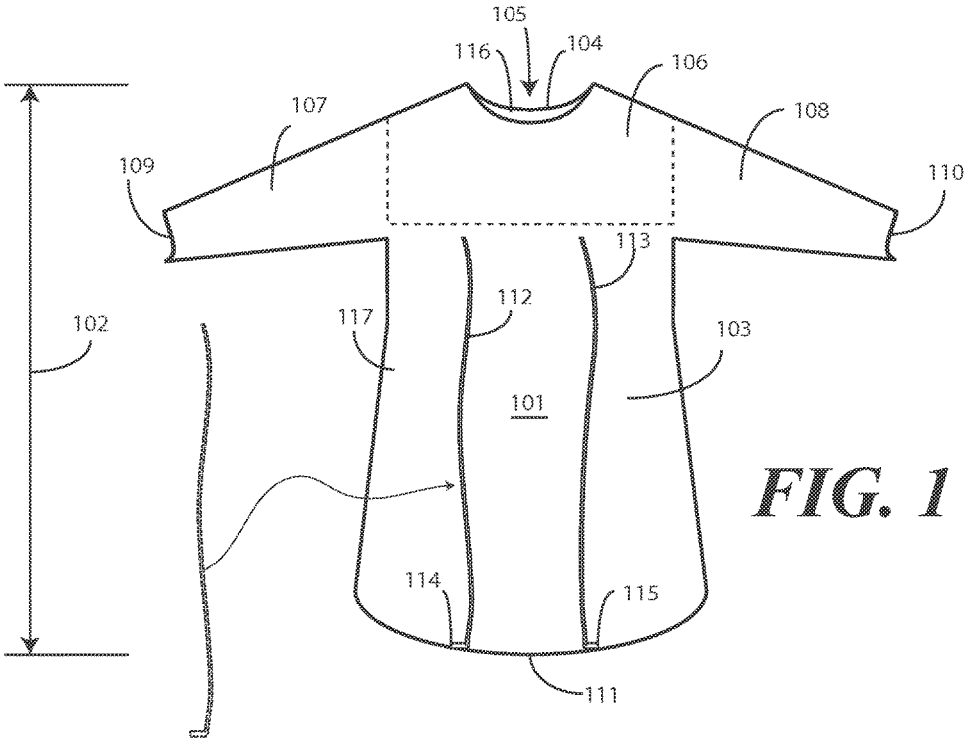
FIG. 1 illustrates one explanatory gown and method step in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. The apparatus components and method steps described herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the disclosure provide a gown that can be donned by the person who will be wearing the gown without assistance from another person and while maintaining sterility of an exterior of the gown. Embodiments of the disclosure allow a user, for example, to don the gown without requiring another person's help and while only touching interior portions of the gown. Consequently, when the gown is fully donned, the exterior portion exposed to medical personnel and others remains sterile. By allowing a user to self-don the gown without compromising sterility, valuable time is saved in an operating room or other medical procedure environment.

In one embodiment, the gown comprises either a rolled fold or an accordion fold that rolls torso-covering portions of the gown so that the sterile exterior of the gown is turned inside the rolled or accordion fold and the interior of the gown, which the user will touch and which is therefore non-sterile, is turned outside the rolled or accordion fold. In one or more embodiments, non-folded portions of the gown can then be turned inside out through the rolled or accordion fold so that the interior portions are exterior the gown and the sterile exterior portions of the gown are disposed interior the gown. Accordingly, a user can pull the gown on initially like a sweatshirt by only touching the interior portions of the gown since they are initially disposed exterior the gown. Once this is done, the user can then unfold the rolled or accordion fold to fully don the gown without ever touching the sterile exterior side. In one or more embodiments, one or more pull tabs are included within the rolled or accordion fold. Once pulling the shoulder covering portion over the shoulders and inserting arms into the sleeves, a user can aseptically pull the one or more pull tabs to release the torso covering portion of the gown along their torso. The user thus self-dons the gown without contaminating sterile portions of the gown.

In one or more embodiments, a donning opening can extend along one side of the gown. Closure devices can be disposed on either side of the donning opening to close the gown. The closing devices can include hook and loop fasteners and adhesively sealed score lines. Not only can the donning opening assist the user in donning the gown, but when the user is done wearing the gown the user can pull a portion of the gown to break through the closure devices to easily remove the gown.

In one embodiment, a gown includes a body covering portion and optionally sleeves extending distally from the body covering portion. The gown can also include a shoulder covering portion defining a head insertion aperture. The body covering portion can comprise a rolled fold. The rolled fold can begin at an end of the gown opposite the head insertion aperture and terminate at the sleeves. In one embodiment, the gown can further include one or more pull tabs disposed within the rolled fold. Each of the one or more pull tabs can include a graspable portion extending out from the rolled fold. In one embodiment, the graspable portion can be used to unroll the rolled fold when pulled away from the head insertion aperture.

In another embodiment, a gown can include a sterile side and another side that is to be disposed adjacent to a user when the gown is being worn, and is thus non-sterile. In one embodiment, the gown includes an accordion fold. The accordion fold can fold portions of the gown from a bottom of the gown to sleeves of the gown. In one embodiment, sterile side folded portions are disposed interior the accordion fold and another side folded portions are disposed exterior the accordion fold. In one embodiment, one or more pull tabs can be included to open the accordion fold without compromising sterility of the sterile side. In one embodiment, when the user initially dons the gown, portions of the sterile side can be disposed interior the gown.

Turning now to FIG. 1, illustrated therein is one example of a gown 100 configured in accordance with one or more embodiments of the disclosure. A body covering portion 101 is configured to at least partially cover the torso of a wearer. The body covering portion 101, in one embodiment, is manufactured from a single, unitary layer of non-woven fabric. The non-woven fabric can be a disposable material, and optionally can include and water resistant lining that prevents the passage of fluids through the body covering portion 101. In one embodiment, the length 102 of the gown 100 is configured to run from a wearer's shoulder to below their knee. In one embodiment, the gown 100 may optionally include pockets or other surface features. The gown 100 may be manufactured in various colors. However, experimental testing has shown that blue is a color particularly well suited for medical procedures due to its high visibility and easy differentiation from a user's skin.

In one embodiment, the non-woven fabric is configured so as to be tearable by a wearer. For example, to non-woven fabric may have a tensile strength of between four and ten pounds. Thus, if aware were to grasp opposing sides of a section of the non-woven fabric, and then pull with a force of between four and ten pounds, the fabric would tear. As will be shown below, in one embodiment a user removes the gown by tearing the non-woven fabric. Accordingly, a non-woven fabric that is easily tearable by a wide range of wearers, e.g., male and female wearers, may be selected for construction of the gown 100 in accordance with such an embodiment.

The body covering portion 101 includes a front portion 103 and a rear portion 104. The front portion 103 is configured as a frontal body covering portion in that it is configured to cover the frontal portion of some or all of a user's body, or in another embodiment the frontal portion of some or all of a user's torso, when the user is wearing the gown. The body covering portion 101 further includes a rear portion 104 that is configured to cover at least a portion of a wearer's backside. In one embodiment, the rear portion 104 has a substantially similar length with the front portion 103, although this will not be the case with all embodiments. In one embodiment for example, the front portion 103 will be longer than the rear portion 104, thereby covering more of the wearer's body in the front than the rear. In another embodiment, the front portion 103 will be shorter than the rear portion 104, thereby covering less of the wearer's body in the front than in the rear.

Figure 2:
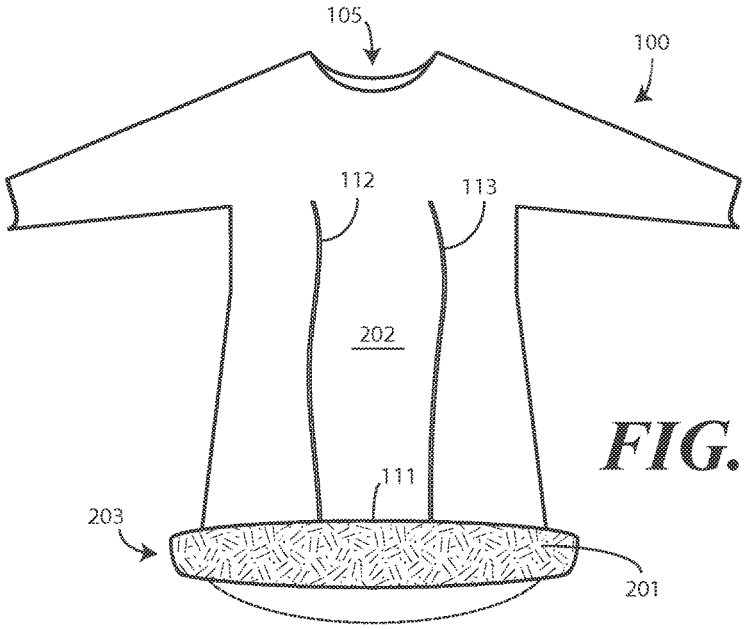
FIG. 2 illustrates one explanatory gown and method step in accordance with one or more embodiments of the disclosure.

In one embodiment, the body covering portion 101 defines a head insertion aperture 105 through which a user may insert their head when donning the gown. In the illustrative embodiment of FIGS. 1 and 2, the head insertion aperture 105 is disposed between the front portion 103 and the rear portion 104, and is surrounded by a shoulder covering portion 106 of the body covering portion 101. The perimeter of the head insertion aperture 105 can take a variety of shapes. For example, in the illustrative embodiment of FIGS. 1 and 2, the head insertion aperture 105 is substantially round. However, the head insertion aperture 105 can also have an angle-tapered flat contour, with two angular side edges radially interfacing with a substantially flat contour. Other head insertion aperture configurations will be obvious to those of ordinary skill in the art having the benefit of this disclosure.

In one embodiment, a first sleeve 107 and a second sleeve 108 extend distally from the body covering portion 101. The first sleeve 107 and the second sleeve 108 are configured to receive wearer's arms when the gown 100 is donned. In one embodiment, each of the first sleeve 107 and the second sleeve 108 are configured as single, unitary pieces of non-woven fabric that are attached with the body covering portion 101 at a seams. The seams can be sewn, although other attachment processes can be used as well. Examples of alternative attachment processes include adhesive bonding, mechanical or press-fit bonding, thermal bonding, and so forth. In other embodiments, the first sleeve 107 and the second sleeve 108 will be integrally formed from a single piece of non-woven material with the body covering portion 101. In still other embodiments, the sleeves will be omitted.

In the illustrated embodiment of FIG. 1, the first sleeve 107 and second sleeve 108 are illustrated as long sleeves. However, it will be clear to those of ordinary skill in the art having the benefit of disclosure that embodiments of the disclosure are not so limited. Gowns in accordance with embodiments of the disclosure may equally be configured with short sleeves or no sleeves has a particular application may warrant.

In the illustrative embodiment of FIG. 1, the sleeves terminate in simple openings 109,110. However, other embodiments can be used. For example, in one embodiment elastic or other gathering material is disposed about a perimeter of the simple openings 109,110. In still other embodiments, the sleeves 107,108 each terminate in a thumb loop. Such thumb loops are shown and described in commonly assigned, copending U.S. Ser. No. 13/276,232, filed Oct. 18, 2011, which is incorporated herein for all purposes. In one embodiment, the thumb loop comprises a thumb insertion aperture through which a wearer's thumb may be inserted. In one embodiment, the thumb loop further comprises a hand saddle curvature termination.

The bottom 111 of the gown 100 can take a variety of shapes. For example, in the illustrative embodiment of FIG. 1, the bottom 111 of the gown 100 is a simple convex curvature. In other embodiments, the bottom 111 of the gown 100 can mirror the shape of the perimeter of the head insertion aperture 105. For example, the bottom 111 can have an angle-tapered flat contour, with two angular side edges radially interfacing with a substantially flat contour. Other embodiments may include different front contours.

In one embodiment, the gown 100 includes one or more pull tabs 112,113. As will be shown below, the one or more pull tabs 112,113 can be used to open either a rolled fold or an accordion fold to facilitate a user self-donning the gown 100 without compromising the sterility of the gown 100. In one embodiment, the one or more pull tabs 112,113 are attached to the gown 100. For example, in one embodiment ends 114,115 of the gown 100 can be attached to the bottom 111 of the gown so that when the torso covering portion of the body covering portion 101 is folded into an accordion fold or rolled fold as described below, lengths of the one or more pull tabs 112,113 will be disposed within the rolled fold or the accordion fold. For example, in one embodiment the one or more pull tabs 112,113 can be sewn to the body covering portion 101, although other attachment processes can be used as well. Examples of alternative attachment processes include adhesive bonding, mechanical or press-fit bonding, thermal bonding, and so forth. In other embodiments, the one or more pull tabs 112,113 will be integrally formed from a single piece of non-woven material with the body covering portion 101. In other embodiments, the one or more pull tabs 112,113 will not be attached to the gown 100, and will simply be placed against the front of the gown 100 in the first step of a folding process. In one embodiment, the ends 114,115 of the one or more pull tabs 112,113 will be aligned with the bottom 111 of the gown 100, while the remainder of the one or more pull tabs 112,113 extends distally toward the head insertion aperture 105. In still other embodiments, the one or more pull tabs 112,113 will be omitted.

In one embodiment, an exterior side 117 of the gown 100 is sterilized to define a sterile side of the gown 100. The sterile side of the gown 100 can be configured to remain sterile so that the gown 100 can be used in medical procedures. In one embodiment, an interior side 116 of the gown 100 can optionally be sterilized as well. However, when donned by a user, the interior side 116 will, of course, touch the user thereby rendering it non-sterile. Accordingly, in some embodiments only the exterior side 117 of the gown 100 will be sterilized initially. In other embodiments, the entire gown 100 will be sterilized, with the interior side 116 intended to become non-sterile when a user dons the gown 100.

Turning now to FIGS. 2-13, illustrated therein is a method for folding the gown 100 in accordance with one or more embodiments of the disclosure. Beginning with FIG. 2, the one or more pull tabs 112,113 have been placed along the front portion 103 of the gown 100 with the ends (114,115) of the one or more pull tabs 112,113 will be aligned with the bottom 111 of the gown 100, while the remainder of the one or more pull tabs 112,113 extends distally toward the head insertion aperture 105. In this illustrative embodiment, the one or more pull tabs 112,113 are not attached to the gown 100.

An initial fold 203 has begun at the bottom 111 of the gown 100, i.e., at the end of the gown 100 opposite the head insertion aperture 105. In this embodiment, the bottom 111 of the gown 100 has been turned upward to initiate a fold, thereby turning the interior side or inner side 201 outwardly facing. The exterior side or outer side 202 is being folded inwardly against itself in this initial fold 203. Note that the lower portions of the one or more pull tabs 112,113 are disposed within an interior of the initial fold 203.

Figure 3:
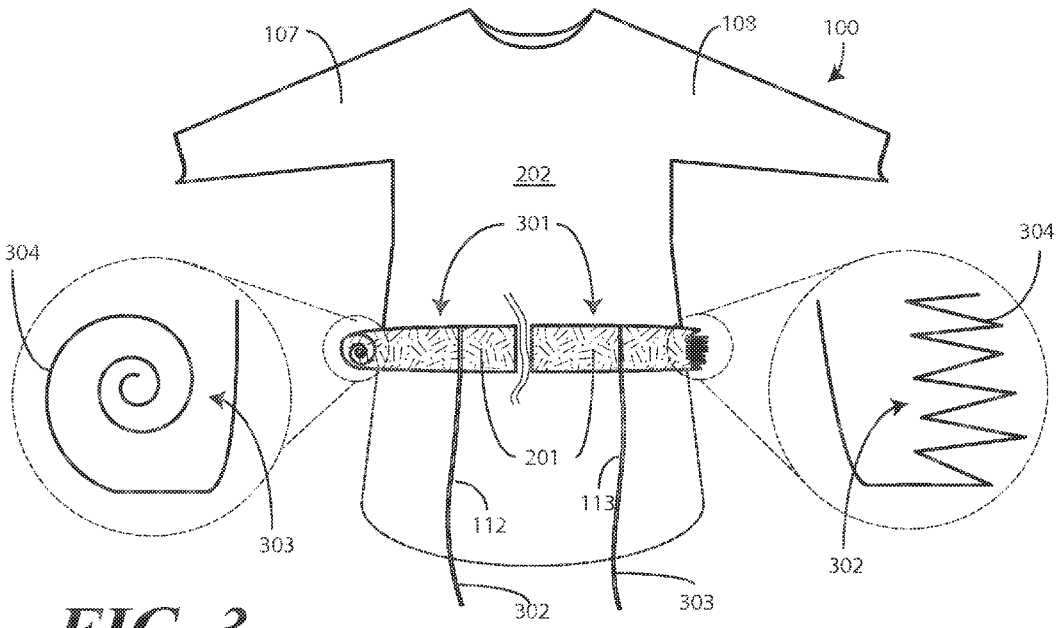
FIG. 3 illustrates one explanatory gown and method step in accordance with one or more embodiments of the disclosure.

Turning to FIG. 3, the initial fold (203) has been transformed into a partial fold 301. For ease of illustration, two different types of folds are shown as examples of the partial fold 301. One is an accordion fold 302, while the other is a rolled fold 303. Any of a rolled fold 303, an accordion fold 302, or combinations thereof can be used to obtain the partial fold 301. The partial fold 301 results when the rolled fold 303, accordion fold 302, or combinations thereof cause the initial fold (203) to continue upwardly along the body covering portion 101 of the gown 100 toward the head insertion aperture 105. For ease of illustration, subsequent figures will be described using the rolled fold 303. However, it is to be noted that the accordion fold 302 can be substituted for the rolled fold 303, and as such descriptions below with respect to the rolled fold 303 should equally apply the accordion fold.

As shown in FIG. 3, when using the rolled fold 303, outer portions 304 of the rolled fold 303 comprise the inner side 201 of the gown 100. Said differently, the outer side 202 is being rolled interior the rolled fold 303 to prevent sterility from being compromised. Accordingly, a user can touch the outer portions 304 of the rolled fold 303 to don the gown 100 without touching the outer side 202 of the gown 100, thereby ensuring that the outer side 202 of the gown 100 remains sterile during the donning process.

Similarly, when using the accordion fold 302, outer portions 304 of the accordion fold 302 comprise the inner side 201 of the gown 100. Said differently, the outer side 202 is being folded interior the accordion fold 302 to prevent sterility from being compromised. Accordingly, a user can touch the outer portions 304 of the accordion fold 302 to don the gown 100 without touching the outer side 202 of the gown 100, thereby ensuring that the outer side 202 of the gown 100 remains sterile during the donning process.

As shown in FIG. 3, where the outer side 202 is a sterile side, and another side, i.e., the inner side 201 is to be touched by the user, use of the rolled fold 303 or the accordion fold 302 to fold the gown 100 from the bottom (111) of the gown 100 to sleeves 107,108 of the gown 100 causes the sterile side folded portions to be disposed interior the accordion fold 302 or the rolled fold 303. The other side, i.e., the inner side 201, is then caused to be disposed exterior the accordion fold 302 or the rolled fold 303.

As also shown in FIG. 3, portions of the one or more pull tabs 112,113 are being captured within the partial fold 301 while it is being folded. As will be described in more detail below, once the partial fold 301 is completed, graspable portions 312,313 of the one or more pull tabs 112,113 will be available to open the accordion fold 302 or unroll the rolled fold 303 without compromising sterility of the sterile side.

Figure 4:
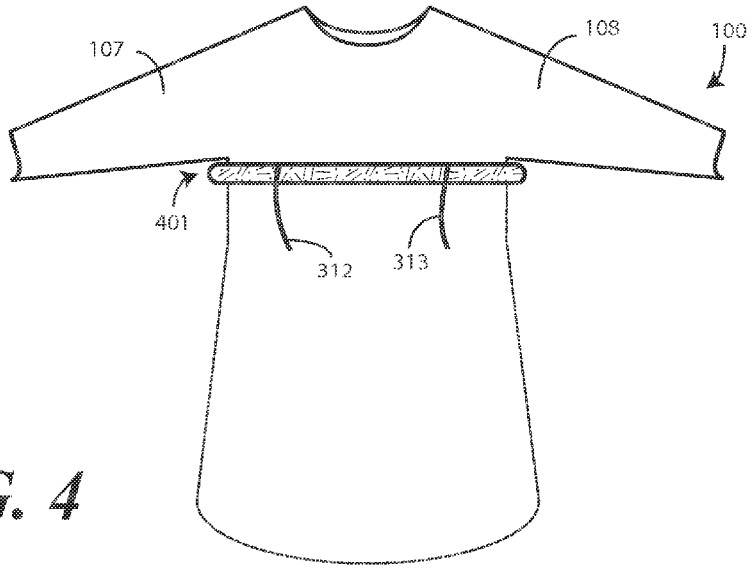
FIG. 4 illustrates one explanatory gown and method step in accordance with one or more embodiments of the disclosure.

Turning now to FIG. 4, the folding of the partial fold 301 has continued to form a completed fold 401. The body covering portion 101 now comprises either a rolled fold (303) or an accordion fold (302) that began at the end (111) of the gown 100 and terminated at the sleeves 107,108. The one or more pull tabs (112,113) are disposed within the rolled fold (303) or the accordion fold (302). Each of the one or more pull tabs (112,113) has a graspable portion 312,313 extending outwardly and away from the rolled fold (303) or the accordion fold (302). In this illustrative embodiment, the graspable portion 312,313 is dangling downwardly from the completed fold 401. In one embodiment, the gown 100 of FIG. 4 is in a partially folded state. In another embodiment, the gown 100 of FIG. 4 is in a completely folded state.

Figure 5:
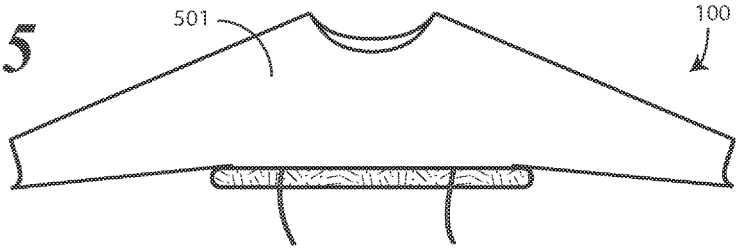
FIG. 5 illustrates one explanatory gown and method step in accordance with one or more embodiments of the disclosure.

Turning to FIG. 5, illustrated therein the gown 100 of FIG. 4. As shown in FIG. 5, there are still sterile portions 501 of the gown 100 that are disposed exterior to the gown 100. When a user dons the gown 100, they may touch the sterile portions 501, thereby compromising sterility. To prevent this, in one embodiment additional folding is employed.

Figure 6:
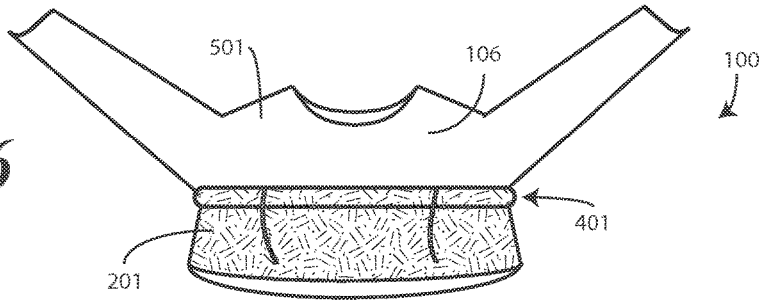
FIG. 6 illustrates one explanatory gown and method step in accordance with one or more embodiments of the disclosure.
Figure 7:
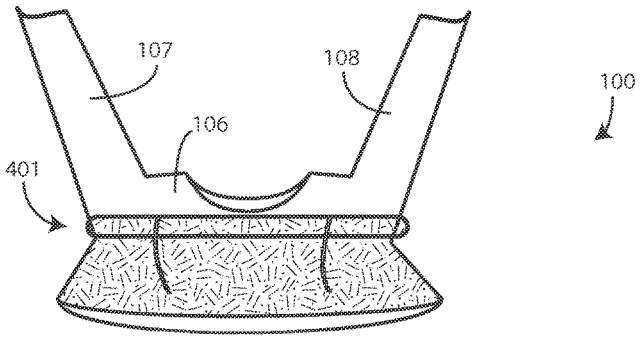
FIG. 7 illustrates one explanatory gown and method step in accordance with one or more embodiments of the disclosure.

Turning to FIG. 6, the shoulder covering portion 106 is being folded inside-out through the completed fold 401. This is causing the inner side 201 of the gown 100 to be exterior the gown 100. A user can touch the inner side 201 when donning the gown 100, but will not touch the sterile portions 501 because they are disposed interior the gown 100. This inside-out folding of the gown 100 continues in FIG. 7. As shown in FIG. 7, the sleeves 107,108 are being folded inside-out through both the completed fold 401 and the shoulder covering portion 106. The resulting gown 100 is shown in FIG. 8, where the various folding operations applied to the gown have caused sterile portions (501) to be disposed interior the gown 100 and user side portions, i.e., the inner side 201 to be disposed exterior the gown 100.

Figure 8:
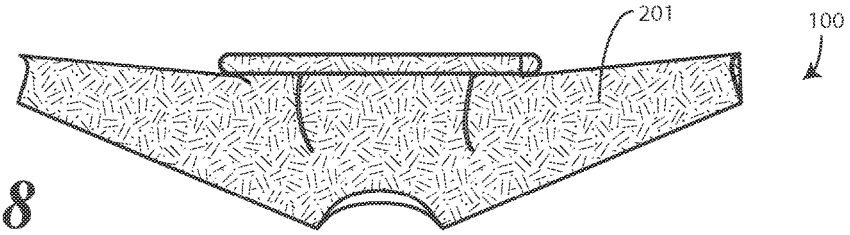
FIG. 8 illustrates one explanatory gown and method step in accordance with one or more embodiments of the disclosure.

Turning to FIG. 9, the gown 100 of FIG. 8 has been rotated 180 degrees so that the head insertion aperture 105 is disposed on the top. As shown in FIGS. 10-11, the sleeves 108,107 can then be folded across the shoulder covering portion 106. As shown in FIG. 12, the sleeves 108,107 can be folded back upon themselves to create a double folded sleeve 1208,1207. As shown in FIG. 13, the shoulder covering portion 106 can then be folded in half. The gown 100 is then ready for packaging and shipment to a user in one embodiment.

Figure 14:
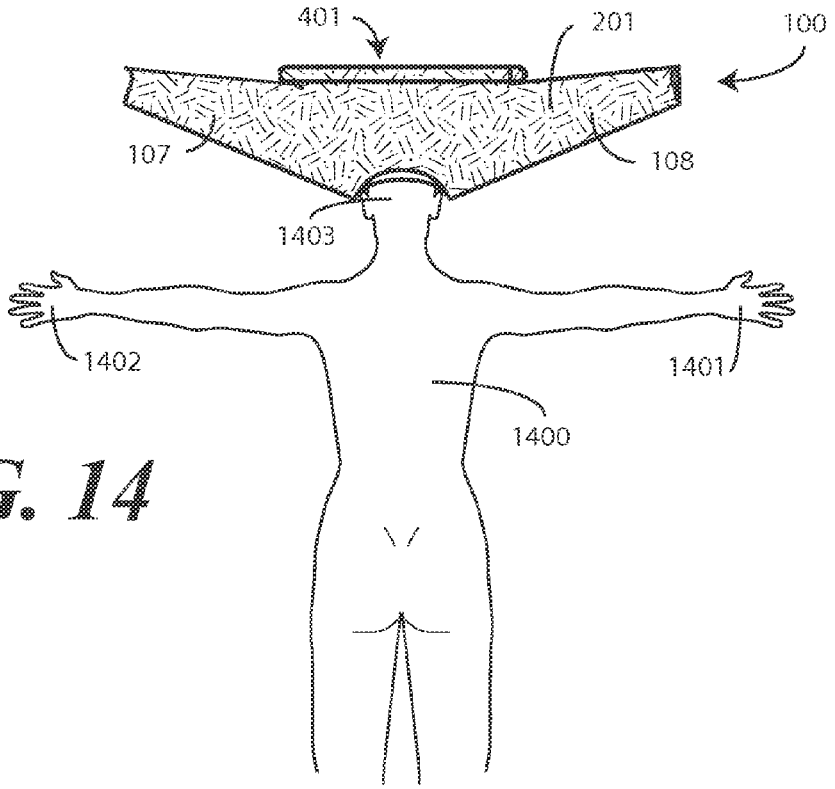
FIG. 14 illustrates one explanatory gown and method step in accordance with one or more embodiments of the disclosure.

Turning now to FIG. 14, a user 1400 has opened any packaging disposed about the gown 100 and has reversed the steps shown in FIGS. 10-13 to obtain the gown 100 of FIG. 8. This gown 100 can then be initially pulled on like a sweatshirt with the user 1400 grasping only the inner side 201 of the gown 100 with their hands 1401,1402. It should be noted that the user 1400 can even don the gown 100 without their head 1403 touching the sterile portions (501) of the gown 100 due to the fact that the completed fold 401 defines a perimeter (into and out of the page as shown in FIG. 14) that is larger than the user's head 1403.

Figure 15:
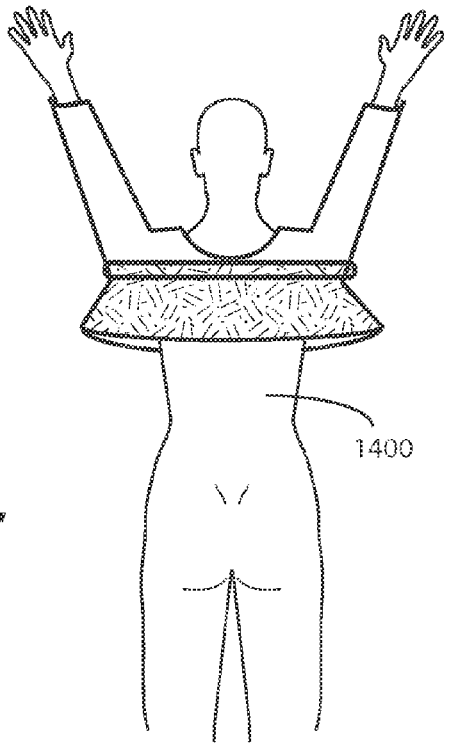
FIG. 15 illustrates one explanatory gown and method step in accordance with one or more embodiments of the disclosure.
Figure 16:
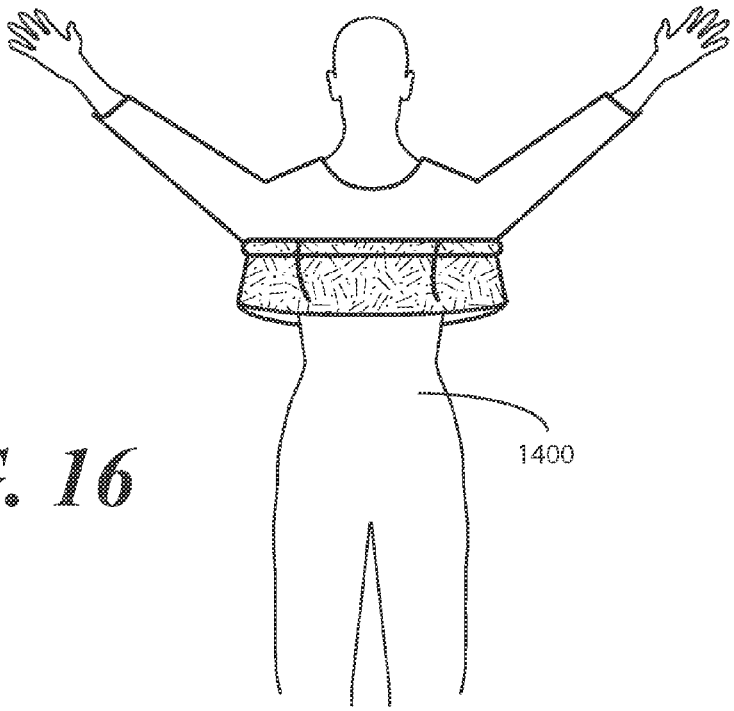
FIG. 16 illustrates one explanatory gown and method step in accordance with one or more embodiments of the disclosure.
Figure 17:
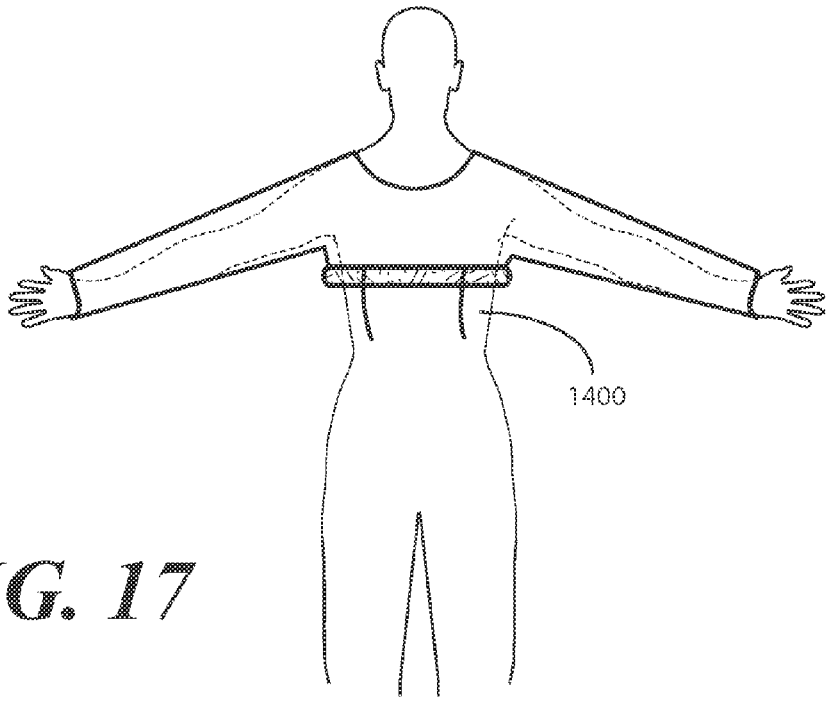
FIG. 17 illustrates one explanatory gown and method step in accordance with one or more embodiments of the disclosure.
Figure 18:
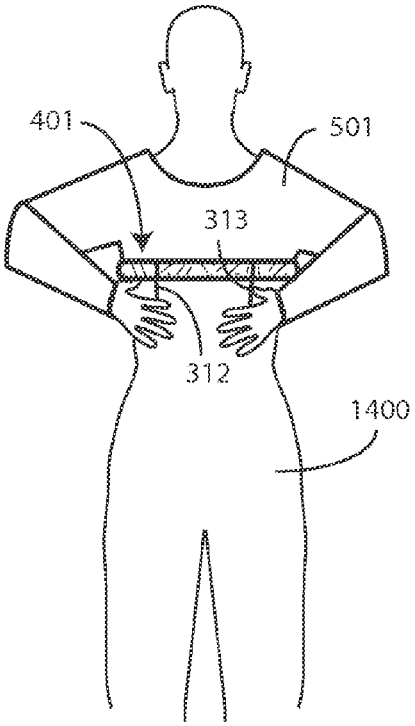
FIG. 18 illustrates one explanatory gown and method step in accordance with one or more embodiments of the disclosure.
Figure 19:
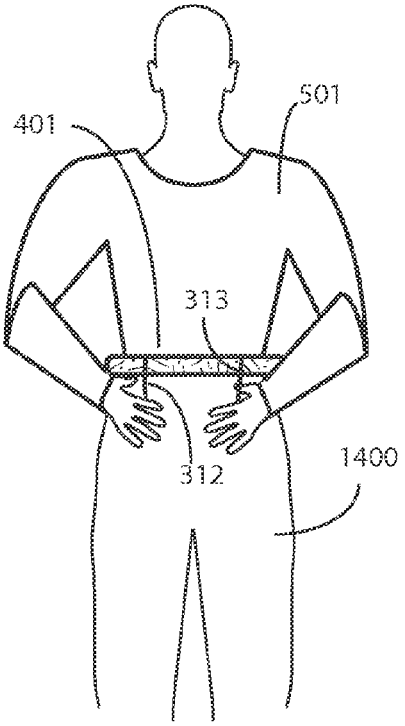
FIG. 19 illustrates one explanatory gown and method step in accordance with one or more embodiments of the disclosure.
Figure 20:
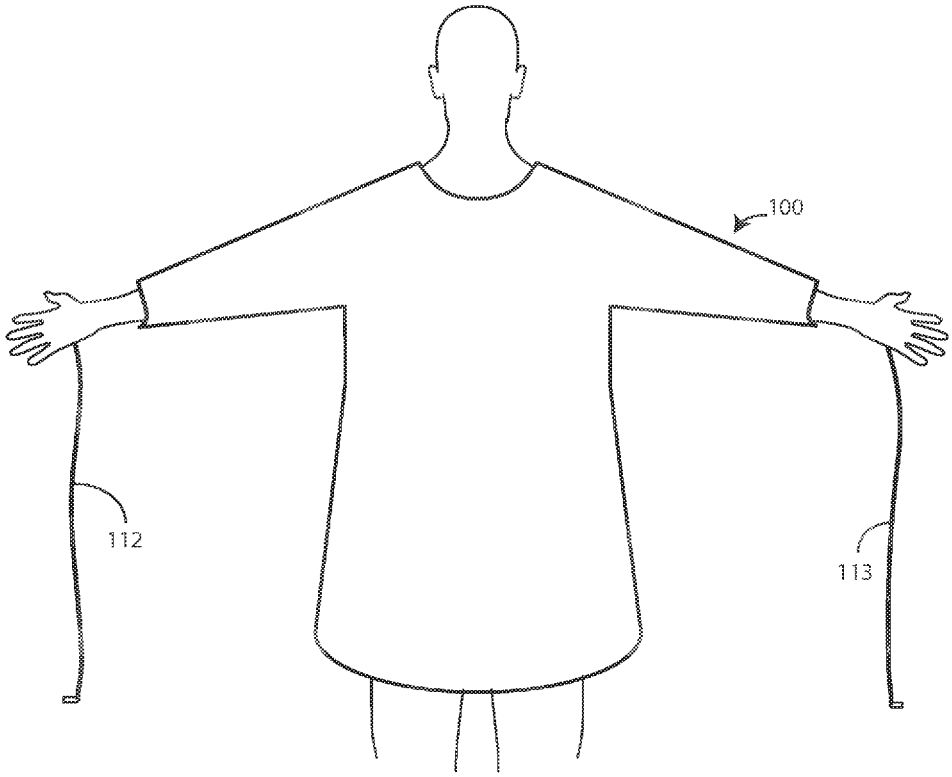
FIG. 20 illustrates one explanatory gown and method step in accordance with one or more embodiments of the disclosure.

As the user 1400 grasps the inner side 201 of the gown 100 and pulls it over their head, this causes the shoulder covering portion 106 to again turn inside-out. The user can place their hands 1401,1402 into the sleeves 107,108 to cause them to again turn inside out. The user 1400 has begun this process in FIG. 15. The user 1400 has completed this process in FIG. 16-17. As shown in FIGS. 18-19, the user 1400 can now grasp the graspable portions 312,313 of the one or more pull tabs (112,113) and pull them downward to unfold the completed fold 401 without touching the sterile portions 501 of the gown 100. Where the completed fold 401 is an accordion fold (302), the grasping and pulling of the graspable portions 312,313 causes the accordion fold (302) to unfold. Where the completed fold 401 is a rolled fold (303), the grasping and pulling of the graspable portions 312,313 causes the rolled fold (303) to unroll. The user 1400 has completed the donning process in FIG. 20. As the one or more pull tabs 112,113 were not attached to the gown 100, they can now be discarded.

The embodiment of FIGS. 6-13 resulted in the gown 100 being folded completely inside out. However, in another embodiment, the gown 100 is only partially folded inside out. Turning now to FIGS. 21-32, such an embodiment will be described.

Figure 21:
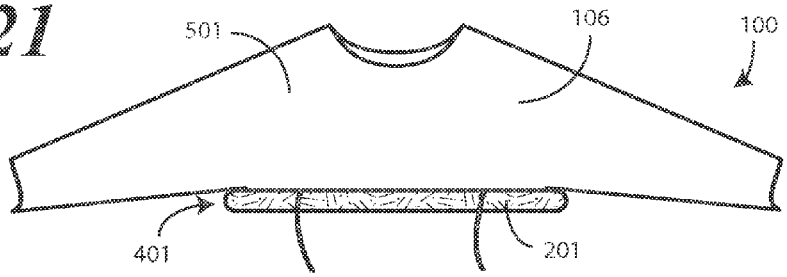
FIG. 21 illustrates one explanatory gown and method step in accordance with one or more embodiments of the disclosure.

Beginning with FIG. 21, the gown 100 is shown substantially as it was in FIG. 5, with sterile portions 501 of the gown 100 that are disposed exterior to the gown 100. Specifically, the sterile portions 501 of the gown 100 are exterior along the shoulder covering portion 106. However, the inner side 201 of the gown 100 is exterior at the completed fold 401. In this embodiment, in contrast to the embodiment above, the gown 100 will not be folded further inside out. A user donning the gown 100 of FIG. 21 can simply insert their arms through the completed fold 401 and will not touch the sterile portions 501 because they are disposed exterior of the gown 100 in this embodiment.

Figure 22:
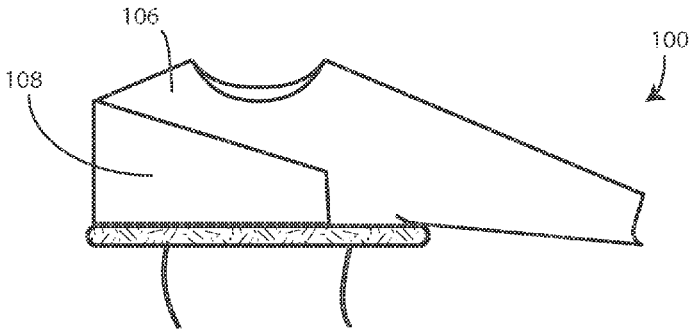
FIG. 22 illustrates one explanatory gown and method step in accordance with one or more embodiments of the disclosure.
Figure 23:
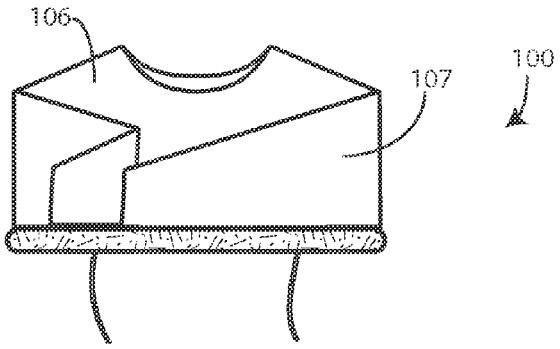
FIG. 23 illustrates one explanatory gown and method step in accordance with one or more embodiments of the disclosure.
Figure 24:
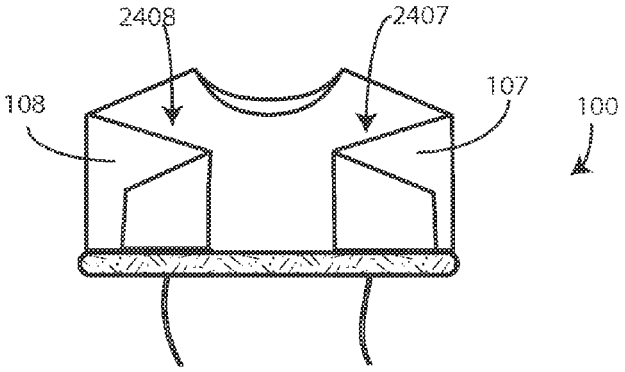
FIG. 24 illustrates one explanatory gown and method step in accordance with one or more embodiments of the disclosure.
Figure 25:
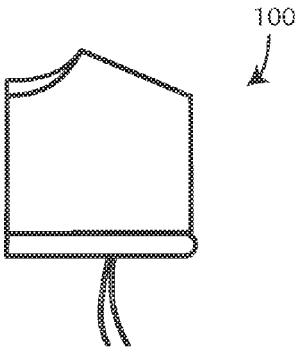
FIG. 25 illustrates one explanatory gown and method step in accordance with one or more embodiments of the disclosure.

As shown in FIGS. 22-23, the sleeves 108,107 can then be folded across the shoulder covering portion 106. As shown in FIG. 24, the sleeves 108,107 can be folded back upon themselves to create a double folded sleeve 2408,2407. As shown in FIG. 25, the shoulder covering portion 106 can then be folded in half. The gown 100 is then ready for packaging and shipment to a user in one embodiment.

Figure 26:
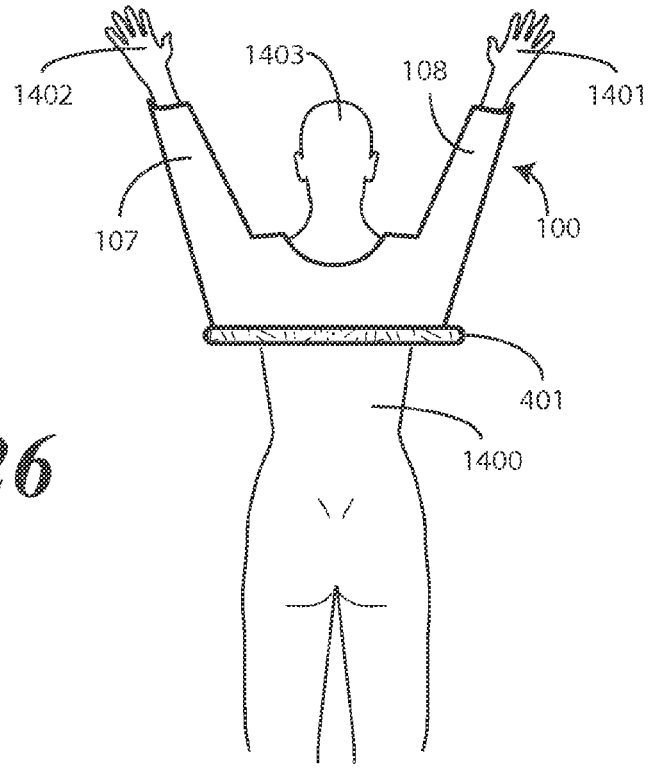
FIG. 26 illustrates one explanatory gown and method step in accordance with one or more embodiments of the disclosure.

Turning now to FIG. 26, a user 1400 has opened any packaging disposed about the gown 100 and has reversed the steps shown in FIGS. 22-25 to obtain the gown 100 of FIG. 21. This gown 100 can then be initially pulled on like a sweatshirt with the user 1400 inserting his hands 1401,1402 and arms into the sleeves 107,108. It should be noted that the user 1400 can even don the gown 100 without their head 1403 touching the sterile portions (501) of the gown 100 due to the fact that the completed fold 401 defines a perimeter (into and out of the page as shown in FIG. 26) that is larger than the user's head 1403.

Figure 27:
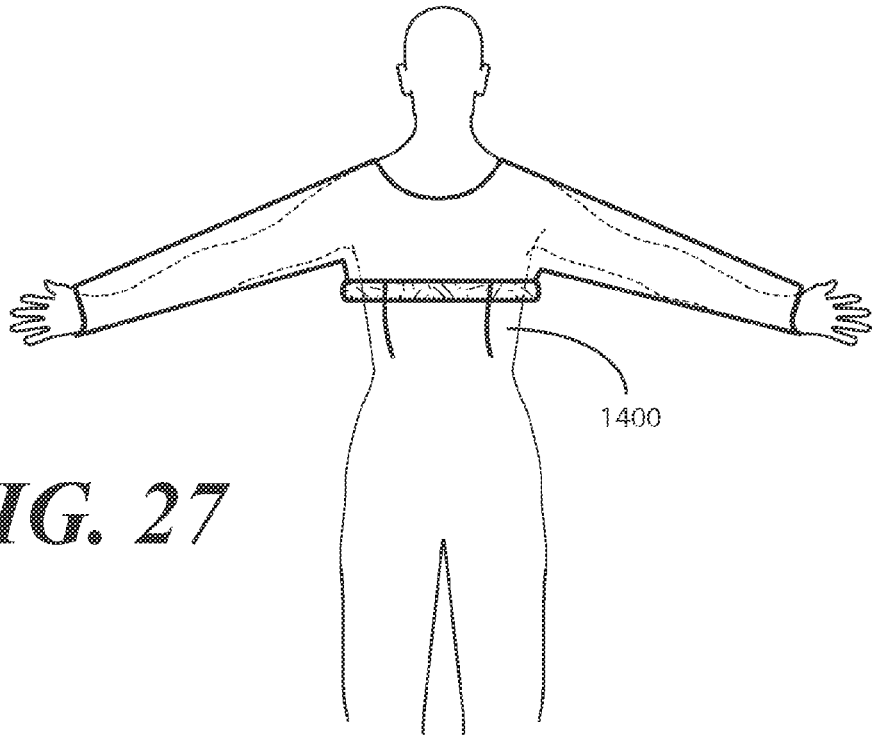
FIG. 27 illustrates one explanatory gown and method step in accordance with one or more embodiments of the disclosure.
Figure 28:
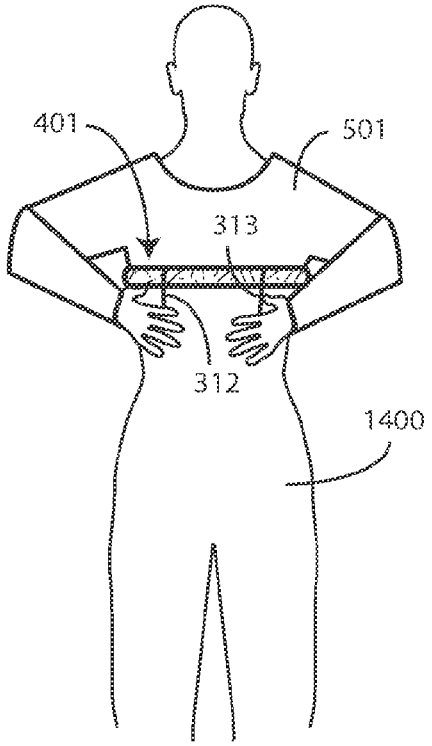
FIG. 28 illustrates one explanatory gown and method step in accordance with one or more embodiments of the disclosure.
Figure 29:
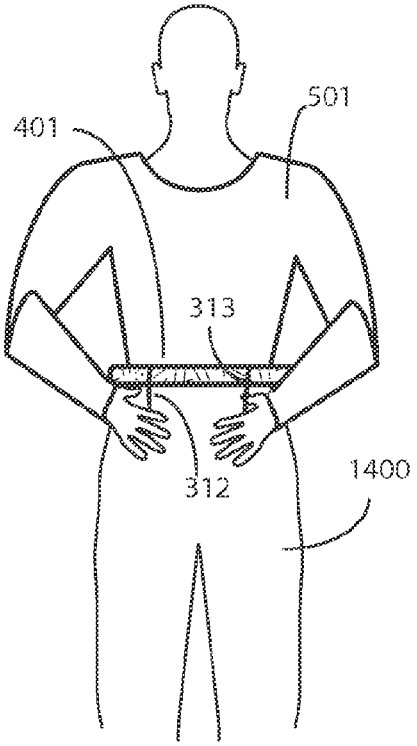
FIG. 29 illustrates one explanatory gown and method step in accordance with one or more embodiments of the disclosure.
Figure 30:
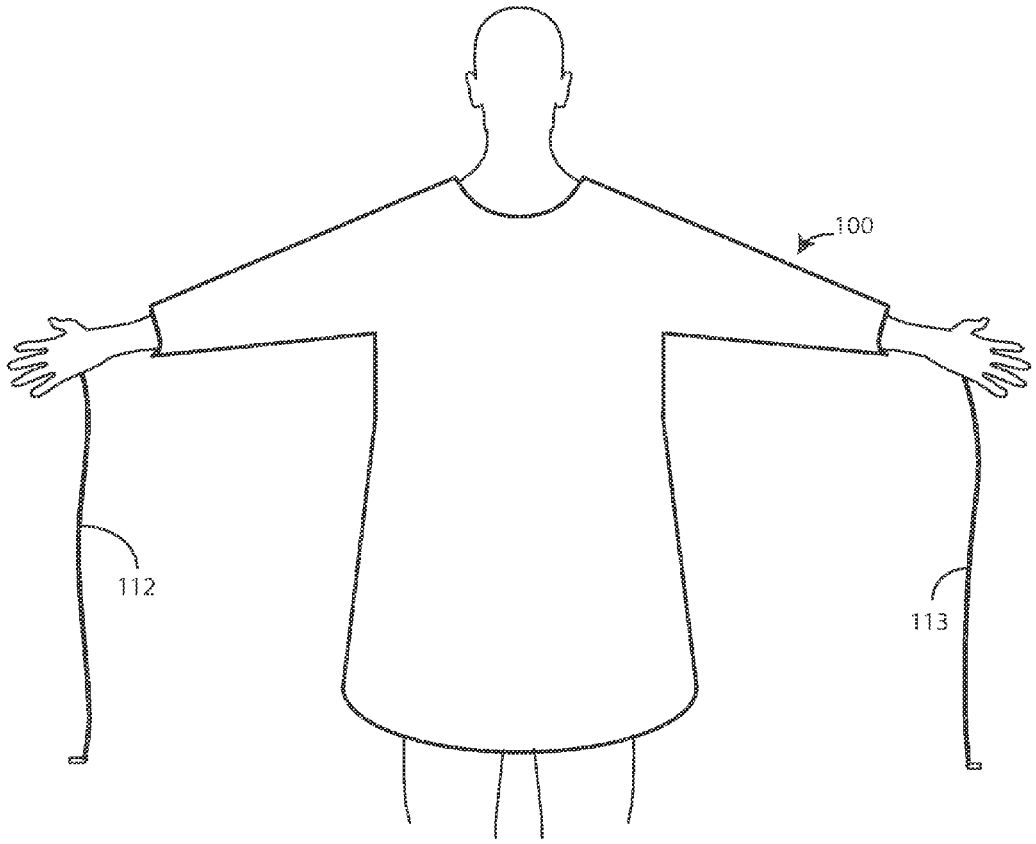
FIG. 30 illustrates one explanatory gown and method step in accordance with one or more embodiments of the disclosure.

The user 1400 then extends their arms as shown in FIG. 27. As shown in FIGS. 28-29, the user 1400 can now grasp the graspable portions 312,313 of the one or more pull tabs (112,113) and pull them downward to unfold the completed fold 401 without touching the sterile portions 501 of the gown 100. Where the completed fold 401 is an accordion fold (302), the grasping and pulling of the graspable portions 312,313 causes the accordion fold (302) to unfold. Where the completed fold 401 is a rolled fold (303), the grasping and pulling of the graspable portions 312,313 causes the rolled fold (303) to unroll. The user 1400 has completed the donning process in FIG. 30. As the one or more pull tabs 112,113 were not attached to the gown 100, they can now be discarded.

Figure 31:
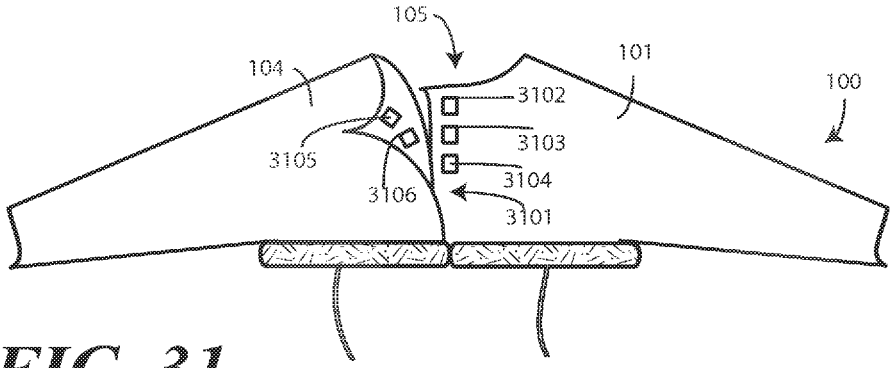
FIG. 31 illustrates one explanatory gown in accordance with one or more embodiments of the disclosure.
Figure 32:
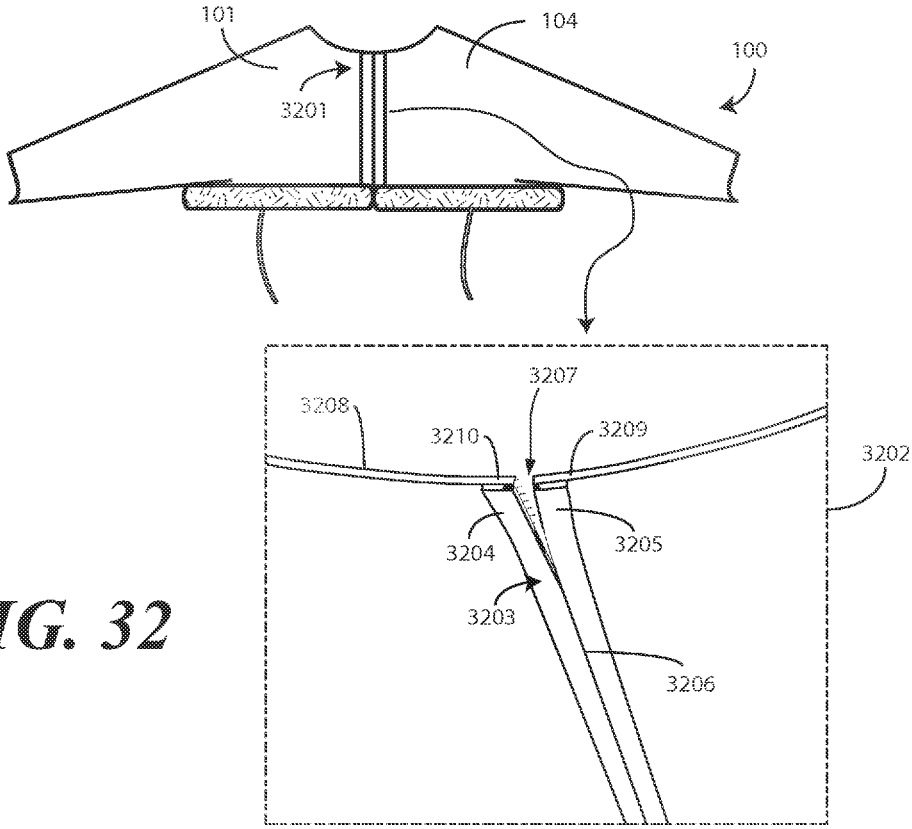
FIG. 32 illustrates one explanatory gown in accordance with one or more embodiments of the disclosure.

Turning now to FIGS. 31-32, in one or more embodiments, the body covering portion 101 defines a donning opening 3101,3201. In these illustrative embodiments, the donning openings 3101,3201 are disposed on the rear portions 104 of the gown 100. The gown 100 is configured this way in these illustrative embodiments because an application in which the gowns 100 will be used calls for the front portion (103) of the gown 100 is configured to be placed against the front of the torso of a wearer. The body covering portion 101 then wraps around and terminates at the donning opening 3101,3201. The donning opening 3101,3201 in this embodiment has a left side and a right side. In the illustrative embodiment of FIG. 31, the donning opening 3101 is configured as a slit that runs the length (102) of the body covering portion 101 from the head insertion aperture 105 down the back of the gown 100 to the bottom (111) of the gown. The donning opening 3201 of the illustrative embodiment of FIG. 32 is configured as a quick release strip that is described in more detail below.

Regardless of configuration, the donning opening 3101, 3201 can be used to assist in donning the gown 100. For instance, a user may open the donning opening 3101,3201 and pass their head, shoulders, and/or torso portions through the donning opening 3101,3201 when donning the gown 100. Said differently, the right side and left side of the donning opening 3101,3201 can be configured to permit the wearer to don the gown 100 by wrapping the right side and left side about the wearer's torso.

In the illustrative embodiment of FIG. 31, one or more closure devices 3102,3103,3104,3105,3106 are disposed on the right and left sides of the donning opening 3101. The one or more closure devices 3102,3103,3104,3105,3106 can be used to close the donning opening 3101 once the user has donned the gown 100. In one or more embodiments, the one or more closure devices 3102,3103,3104,3105,3106 can comprise a series of horizontally aligned closure devices so that the one or more closure devices 3102,3103,3104,3105, 3106 can be used to adjust a size of the perimeter of the head insertion aperture 105. In one embodiment, the one or more closure devices 3102,3103,3104,3105,3106 comprise hook and loop fasteners. Other types of fasteners suitable for use as the one or more closure devices 3102,3103,3104,3105, 3106, such as adhesive closure devices, will be obvious to those of ordinary skill in the art having the benefit of this disclosure.

In the illustrative embodiment of FIG. 32, the donning opening 3201 comprises a quick release feature 3202 known as a "zip strip." Such a quick release feature 3202 is described in commonly assigned, copending U.S. application Ser. No. 13/589,640, filed Aug. 20, 2012, which is incorporated herein by reference for all purposes.

An adhesive tape strip 3203 generally includes a first strip side 3204 and a second strip side 3205, which are connected along a strip scoreline 3206 that partially scores the adhesive tape strip 3203 leaving a bridging area disposed beneath the strip scoreline 3206 across to bridge the first strip side 3204 and the second strip side 3205. The strip scoreline 3206 is generally formed by severing the adhesive tape strip 3203 along its length partially through its thickness such that a separated area is formed above the bridging area between the first strip side 3204 and the second strip side 3205. Thus, based at least in part on the relatively small thickness of the bridging area, the first strip side 3204 can be easily separated from the second strip side 3205 when a user wants to remove the gown 100. Also, the adhesive tape strip 3203 can be easily separated from the body covering portion 101 by selecting an appropriate removable adhesive material when fixing the adhesive tape strip 3203 to the body covering portion 101. In this exemplary embodiment, the strip scoreline 3206 is generally centrally positioned along the width (i.e., narrow dimension) of the adhesive tape strip 3203.

The adhesive tape strip 3203 can be positioned such that the strip scoreline 3206 overlaps a gown cut 3207 of the gown 100. The gown cut 3207, in one embodiment, is formed by completely severing the body covering portion 101, any included incise film, and any included release liner, from the top exterior edge 3208 through the body covering portion 101. In another embodiment, the gown cut 3207 is formed by partially severing the body covering portion 101, and either partially or completely severing any included incise film and any included release liner. In yet another embodiment, the gown cut 3207 can be formed by perforating the body covering portion 101, and one of partially severing, completely severing, or perforating any included incise film and any included release liner as well. Other methods of forming the gown cut 3207 will be obvious to those of ordinary skill in the art having the benefit of this disclosure.

In one embodiment, the gown cut 3207 is generally defined by two adjoining cut edges, a first cut edge 3209 and a second cut edge 3210. The adhesive tape strip 3203 secures the adjoining first and second cut edges 3209,3210 of the gown cut 3207 to each other by having the first strip side 3204 fixed (e.g., glued) to the a first cut edge 3209 and having the second strip side 3205 fixed to the second cut edge 3210. In one embodiment, the bridging area is the only material that holds together the first and second cut edges 3209-3210.

In addition to securing the gown cut 3207, the adhesive tape strip 3203 seals the gown cut 3207 to eliminate any violation of a sterile field formed on the exterior side of the gown 100. Because the strip scoreline 3206 extends only through part of the thickness of the adhesive tape strip 3203, a protective barrier—the bridging area—is inherently present during the medical procedure.

In one or more embodiments, the gowns 100 of FIGS. 31-32 are designed to be easily removable from a user once used. For example, in the embodiment of FIG. 31 the one or more closure devices 3102,3103,3104,3105,3106 can be pulled apart when a user pulls on the front of the gown. In the embodiment of FIG. 32, the bridging member of the zip strip can be configured to tear when the user pulls on the front of the gown 100. In one or more embodiments, to further assist the user in removing the gown, the non-woven fabric defining the body covering portion 101 can be configured so as to be tearable by a wearer. For example, to non-woven fabric may have a tensile strength of between four and ten pounds. Thus, if a user were to grasp opposing sides of a section of the non-woven fabric, and then pull with a force of between four and ten pounds, the fabric would tear. In one or more embodiments, a user removes the gown by tearing the non-woven fabric. Accordingly, a non-woven fabric that is easily tearable by a wide range of wearers, e.g., male and female wearers, may be selected for construction of the gown 100 in accordance with such an embodiment.

Figure 33:
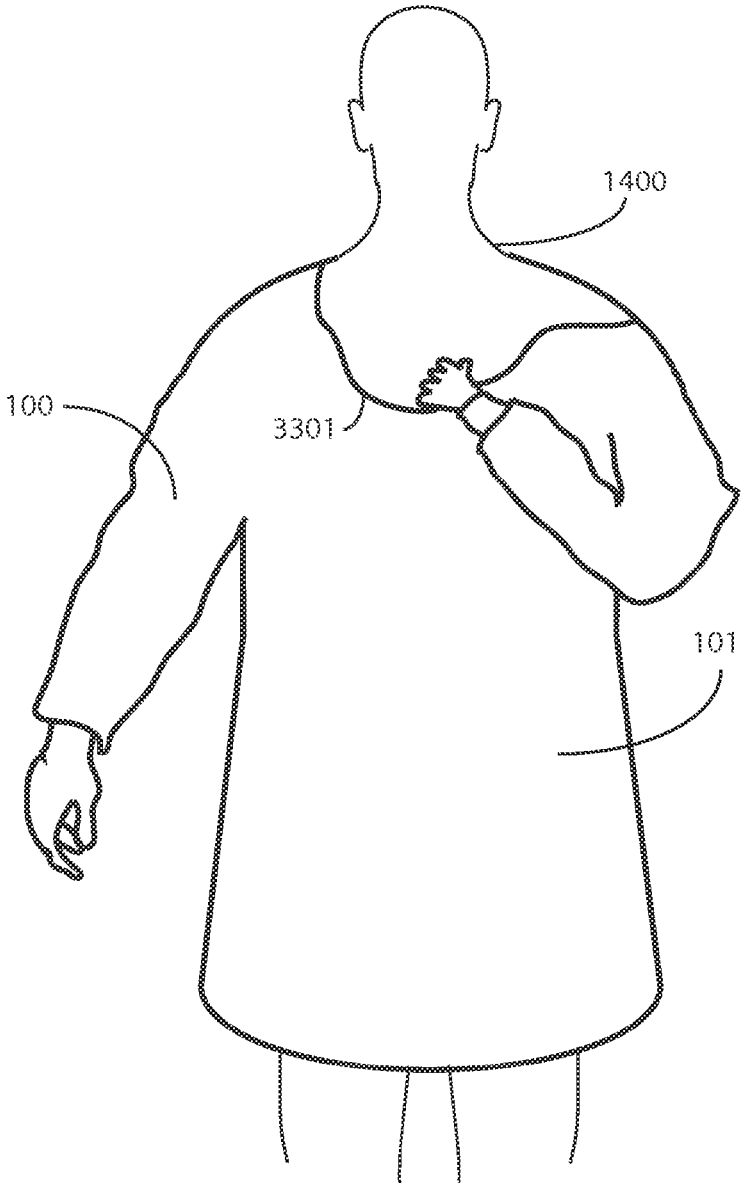
FIG. 33 illustrates one explanatory gown and method step in accordance with one or more embodiments of the disclosure.

As shown in FIG. 33, in one embodiment a user 1400 grasps the neck 3301 of the gown 100 to quickly remove it. If the gown 100 is that of FIG. 31, this can cause the one or more closure devices (3102,3103,3104,3105,3106) can be pulled apart, and the body covering portion 101 can optionally tear. If the gown 100 is that of FIG. 32, the bridging member of the zip strip can separate, and the body covering portion 101 can optionally tear.

Figure 34:
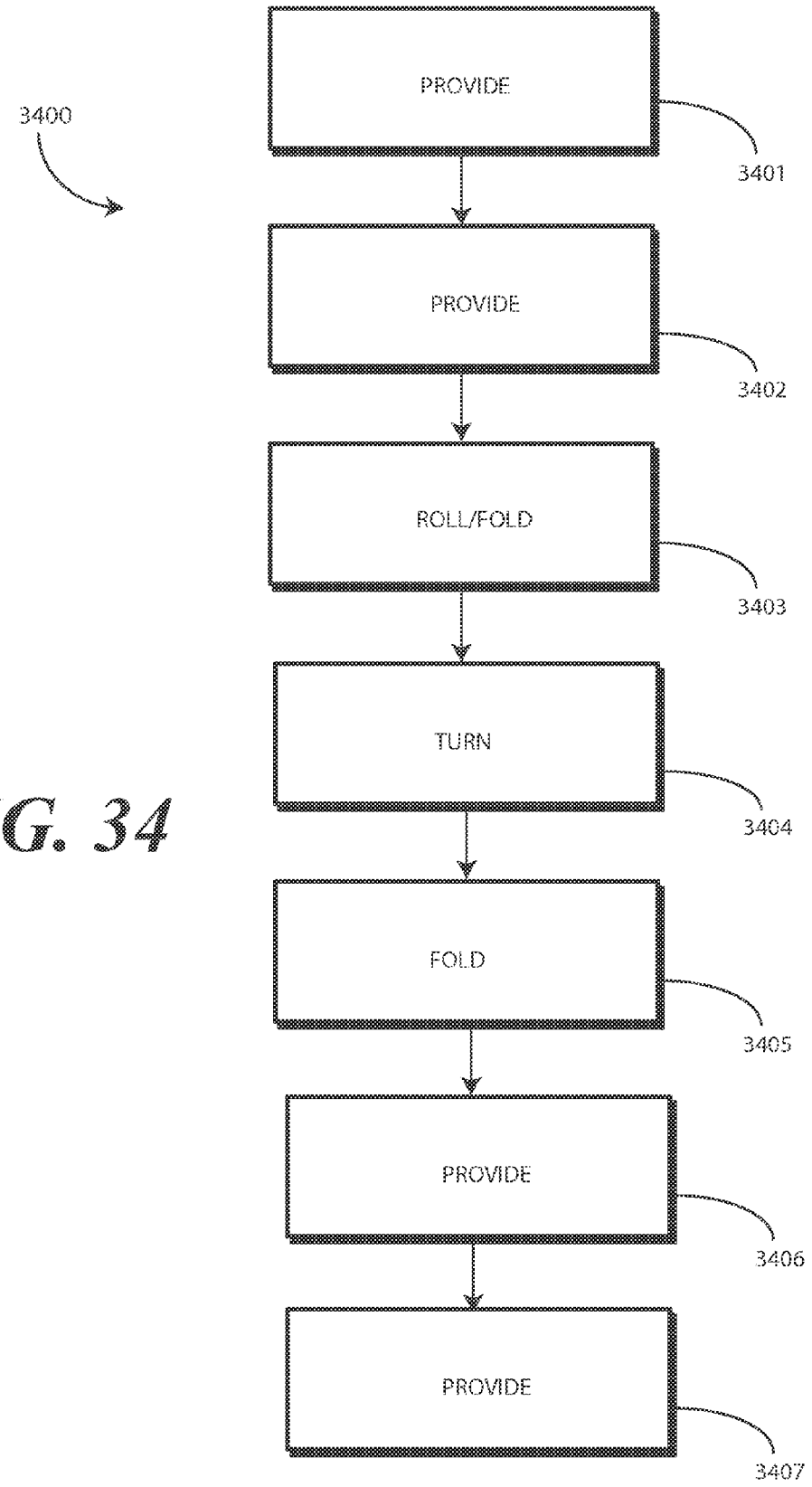
FIG. 34 illustrates a method in accordance with one or more embodiments of the disclosure.

Turning now to FIG. 34, illustrated therein is a method 3400 of creating a gown. The steps of the method have largely been described above with reference to FIGS. 1-13, and then with another embodiment in FIGS. 21-30, and as such will only cursorily be described here.

At step 3401, the method 3400 comprises providing a gown. At step 3402, the method 3400 comprises, optionally, providing one or more pull tabs. At step 3403, the method 3400 comprises rolling or folding a body covering portion of the gown from a bottom end disposed opposite a neck opening toward sleeves of the gown. In one embodiment, the rolling or folding of step 3403 comprises capturing portions of the pull strips within one of a rolled fold or an accordion fold. In one embodiment, the rolling or folding of step 3403 causes an interior side of the gown to be disposed outside the rolled fold. In one embodiment, such as that used in FIGS. 21-30, the method proceeds to step 3405. At optional step 3404, which can be included in the embodiment of FIGS. 1-13, the method 3400 comprises turning a shoulder covering portion of the gown inside out through the rolled fold.

At step 3405, the method 3400 comprises folding the sleeves of the gown inside out. At step 3406, the method 3400 optionally comprises providing a donning opening along one side of the gown. At step 3407, the method 3400 optionally comprises providing a closure for the donning opening.

Figure 35:
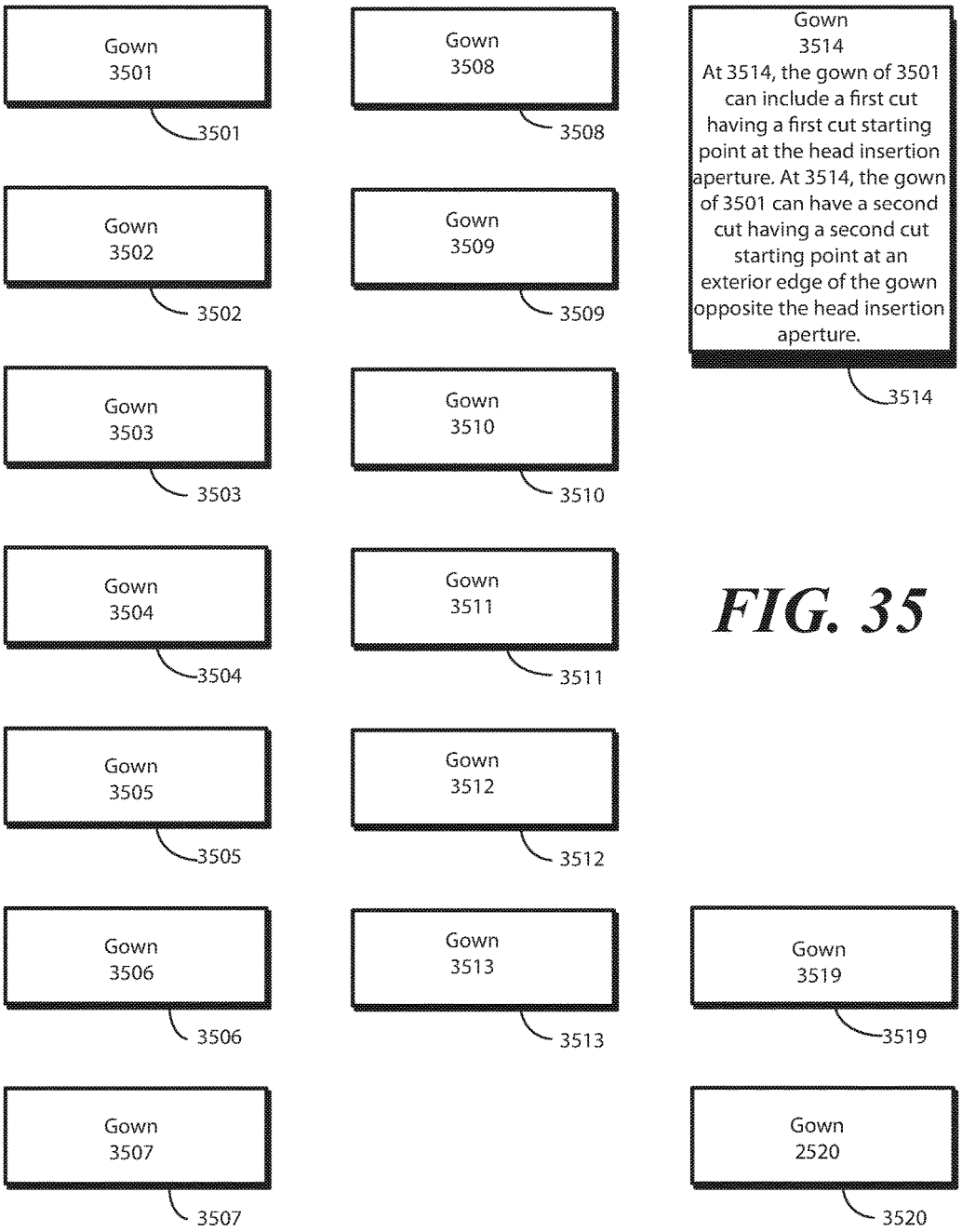
FIG. 35 illustrates various embodiments of the disclosure.

Turning now to FIG. 35, illustrated therein are various embodiments of the disclosure. At 3501, a gown comprises a body covering portion. At 3501, the gown can comprise sleeves extending distally from the body covering portion. At 3501, the gown can comprise a shoulder covering portion defining a head insertion aperture. At 3501, the body covering portion can comprise one of a rolled fold or an accordion fold. At 3501, the rolled fold or accordion fold can begin at an end of the gown opposite the head insertion aperture and terminate at the sleeves.

At 3502, the gown of 3501 can include one or more pull tabs disposed within the rolled fold. At 3502, each of the one or more pull tabs can comprise a graspable portion extending out from the rolled fold. At 3503, the graspable portion of 3502 can be to unroll the rolled fold when pulled away from the head insertion aperture. At 3504, the one or more pull tabs of 3502 can be attached to the gown. At 3505, the outer portions of the rolled fold or the accordion fold can comprise an inner side of the gown.

At 3506, the shoulder covering portion of 3501 can be folded inside-out through the rolled fold or the accordion fold. At 3507, the sleeves of 3506 can be folded inside out through the shoulder covering portion. At 3508, the sleeves of 3501 can be folded across a portion of the shoulder covering portion. At 3509, the shoulder covering portion of 3508 can be folded in half.

At 3510, the body covering portion of 3501 can define a donning opening. At 3511, the donning opening of 2510 can be disposed on a rear side of the gown. At 3512, the gown of 3510 can include one or more closure devices disposed on each side of the donning opening. At 3513, the closure devices of 3512 can be hook and loop fasteners.

At 3514, the gown of 3501 can include a first cut having a first cut starting point at the head insertion aperture. At 3514, the gown of 3501 can have a second cut having a second cut starting point at an exterior edge of the gown opposite the head insertion aperture. At 3514, each cut can extend completely through a thickness of the gown such that two adjoining cut edges are completely severed from one another. At 3514, the gown of 3501 can comprise an adhesive tape strip positioned along a length of each cut. At 3514, the adhesive tape strip can overlap at least a portion of the gown on both sides of each cut to initially secure the two adjoining cut edges to each other. At 3514, each cut can include a scoreline extending along the length of the adhesive tape strip. At 3514, the scoreline can extend only partially through the thickness of the adhesive tape strip to permit easy tearing of the adhesive tape strip for separation of the two adjoining cut edges.

At 3519, a gown can include a sterile side and another side. At 3519, the gown can include an accordion fold from a bottom of the gown to sleeves of the gown. At 3519, the sterile side folded portions can be disposed interior the accordion fold. At 3519, another side folded portions can be disposed exterior the accordion fold. At 3519, the gown can include one or more pull tabs. At 3519 the one or more pull tabs can be to open the accordion fold without compromising sterility of the sterile side. At 3520, the gown of 3519 can include portions of the sterile side disposed interior the gown.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A gown, comprising:

a body covering portion;

sleeves extending distally from the body covering portion;

a shoulder covering portion defining a head insertion aperture;

the body covering portion comprising a rolled fold beginning at an end of the gown opposite the head insertion aperture and terminating at the sleeves.

2. The gown of claim 1, further comprising one or more pull tabs disposed within the rolled fold, each of the one or more pull tabs comprising a graspable portion extending out from the rolled fold.

3. The gown of claim 2, the graspable portion to unroll the rolled fold when pulled away from the head insertion aperture.

4. The gown of claim 2, the one or more pull tabs attached to the gown.

5. The gown of claim 2, outer portions of the rolled fold comprising an inner side of the gown.

6. The gown of claim 1, the shoulder covering portion folded inside-out through the rolled fold.

7. The gown of claim 6, the sleeves folded inside out through the shoulder covering portion.

8. The gown of claim 1, the sleeves folded across a portion of the shoulder covering portion.

9. The gown of claim 8, the shoulder covering portion folded in half.

10. The gown of claim 1, the body covering portion defining a donning opening.

11. The gown of claim 10, the donning opening disposed on a rear side of the gown.

12. The gown of claim 10, further comprising one or more closure devices disposed on each side of the donning opening.

13. The gown of claim 12, the one or more closure devices comprising hook and loop fasteners.

14. The gown of claim 1, further comprising:

a first cut having a first cut starting point at the head insertion aperture; and a second cut having a second cut starting point at an exterior edge of the gown opposite the head insertion aperture, wherein each cut:

extends completely through a thickness of the gown such that two adjoining cut edges are completely severed from one another;

comprises an adhesive tape strip positioned along a length of the each cut, the adhesive tape strip overlapping at least a portion of the gown on both sides of the each cut to initially secure the two adjoining cut edges to each other; and comprises a scoreline extending along the length of the adhesive tape strip, the scoreline extending only partially through the thickness of the adhesive tape strip to permit easy tearing of the adhesive tape strip for separation of the two adjoining cut edges.

15. A method, comprising:

providing a gown comprising sleeves extending distally from a body covering portion;

providing one or more pull tabs; and rolling the body covering portion of the gown from an bottom end disposed opposite a head insertion aperture toward sleeves of the gown, the rolling capturing portions of the one or more pull tabs within a rolled fold and causing an interior side of the gown to be disposed outside the rolled fold.

16. The method of claim 15, further comprising turning a shoulder covering portion of the gown inside out through the rolled fold and folding the sleeves inside out.

17. The method of claim 15, further comprising providing a donning opening along one side of the gown.

18. The method of claim 17, further comprising providing a closure for the donning opening.

* * * * *